US012710206B2

(12) United States Patent
Chan

(10) Patent No.: US 12,710,206 B2
(45) Date of Patent: Aug. 18, 2026

(54) ENERGY TRANSMISSION DEVICE AND HEAT EXCHANGE DEVICE

(71) Applicant: Evans Yin Fung Chan, Hong Kong (CN)

(72) Inventor: Evans Yin Fung Chan, Hong Kong (CN)

( * ) Notice: Subject to any disclaimer, the term of this patent is extended or adjusted under 35 U.S.C. 154(b) by 125 days.

(21) Appl. No.: 18/705,018

(22) PCT Filed: Oct. 24, 2022

(86) PCT No.: PCT/CN2022/126995
§ 371 (c)(1),
(2) Date: Apr. 26, 2024

(87) PCT Pub. No.: WO2023/071976
PCT Pub. Date: May 4, 2023

(65) Prior Publication Data

US 2025/0003652 A1 Jan. 2, 2025

(30) Foreign Application Priority Data

Oct. 26, 2021 (HK) ..... 32021041227.8

(51) Int. Cl.
*F25B 41/20* (2021.01)
*F25B 1/00* (2006.01)

(52) U.S. Cl.
CPC ..... *F25B 41/20* (2021.01); *F25B 1/00* (2013.01)

(58) Field of Classification Search
CPC ..... F25B 41/20; F25B 1/00; A47J 36/2433; A47J 36/38; A47J 36/24; A47J 2027/043; A47J 27/04; A47J 27/13
See application file for complete search history.

(56) References Cited

U.S. PATENT DOCUMENTS 2,782,611 A * 2/1957 Atchison ..... F24F 1/0323 62/427
3,199,583 A * 8/1965 Hood, Jr. ..... F28F 21/067 165/135

(Continued)

FOREIGN PATENT DOCUMENTS

CN 101263346 A 9/2008
CN 101520256 A 9/2009

(Continued)

OTHER PUBLICATIONS

International Search Report from related PCT International Application No. PCT/CN2022/126995, dated Dec. 12, 2022, 6 pages.

*Primary Examiner* — Marc E Norman
(74) *Attorney, Agent, or Firm* — Tucker Ellis LLP; Michael G. Craig; Bennett E. Kuhar

(57) ABSTRACT

An energy transmission device includes a sealed first fluid path including a first channel and a second channel for a first fluid to flow, a compressor, and a regulating valve. A first heat exchanger is formed at least partially by the first channel for a first vapor to flow and release heat and a second heat exchanger is formed at least partially by the second channel for a first liquid to flow and absorbs heat. A spiral first flow guide structure is arranged within the first heat exchanger and a spiral second flow guide structure is arranged within the second heat exchanger. The compressor and the regulating valve are configured to maintain a pressure difference in the first and the second channel during energy transmission. At least one of the said flow guide structures is movable.

20 Claims, 7 Drawing Sheets

(56) References Cited

U.S. PATENT DOCUMENTS

| | | | | |
|---|---|---|---|---|
| 5,075,121 | A | 12/1991 | Desage et al. | |
| 5,509,274 | A | 4/1996 | Lackstrom | |
| 10,254,007 | B2 | 4/2019 | Chan | |
| 2020/0231425 | A1 * | 7/2020 | Porter ..... | B67D 1/0861 |

FOREIGN PATENT DOCUMENTS

| | | | |
|---|---|---|---|
| CN | 103756692 | A | 4/2014 |
| CN | 104697166 | A | 6/2015 |
| CN | 108562179 | A | 9/2018 |
| FR | 3014547 | A1 | 6/2015 |

* cited by examiner

--Prior Art--

ENERGY TRANSMISSION DEVICE AND HEAT EXCHANGE DEVICE

CROSS-REFERENCE TO RELATED APPLICATIONS

This application is a national phase application of International Application No PCT/CN2022/126995, filed Oct. 24, 2022, which claims priority to Hong Kong Patent application Ser. No. 32021041227.8, filed Oct. 26, 2021, all of which are incorporated herein by reference.

BACKGROUND

The present application relates to an energy transmission technology, and in particular, to a heat exchange device.

Hot water has a wide range of uses in people's daily lives, such as cooking. Generally speaking, during cooking with hot water, it is generally necessary to heat the water to boiling to cook food, or heat the water to generate steam to steam the food. However, high-temperature steam is generally discharged into the ambient atmosphere during or after cooking, and the boiled water after cooking is generally treated as wastewater or naturally cooled. The steam contains a lot of heat energy, especially latent heat absorbed during liquid evaporation, which is as high as 2250 KJ/Kg. In real life, the heat energy is often wasted. People have been trying to use various methods to recover and utilize such lost and wasted energy.

U.S. Pat. No. 10,254,007 B2 discloses a steam cooking device A41 as shown in FIG. 1, which includes a first heat exchanger A6 and a second heat exchanger A46. The first heat exchanger A6 is configured to exchange heat between a liquid working fluid A21 (such as water) and steam A53, such that the steam A53 releases heat and is condensed, while the working fluid A21 absorbs latent heat released during the condensation of the steam A53 so as to be evaporated and vaporized. The second heat exchanger A46 is configured to exchange heat between the vaporized working fluid A21 and an aqueous liquid A45. Specifically, the working fluid A21 vaporized in the first heat exchanger A6 is liquefied in the second heat exchanger A46 due to heat exchange and releases latent heat in this process, thereby heating and boiling the aqueous liquid A45 to generate the steam A53 to heat food 52. Although the cooking device can recover a part of heat energy through heat exchange, its recovery efficiency still has the following problems.

Specifically, as shown in FIG. 1:

1) In heat exchange at the first heat exchanger A6, a very large part of the steam A53 is first condensed into water drops after heat exchange and is attached to fins or an outer wall of a pipeline of the first heat exchanger A6. Since the liquid water drops are not good heat conductors, the liquid water drops may block the heat conduction between the steam A53 and the fins and the outer wall of the pipeline of the first heat exchanger A6, thereby reducing the efficiency of heat exchange between the steam A53 and the working fluid A21.

At the same time, working vapor bubbles formed by vaporization of the liquid working fluid A21 are also attached to an inner wall of the pipeline of the first heat exchanger A6. Since the vapor bubbles are also not good heat conductors, the vapor bubbles may block the heat conduction between the liquid working fluid A21 and the inner wall of the pipeline of the first heat exchanger A6, thereby reducing the efficiency of heat exchange between the liquid working fluid A21 and the steam A53 at the first heat exchanger A6.

2) In heat exchange at the second heat exchanger A46, the vaporous working fluid A21 is first condensed into a liquid state inside a pipeline after heat exchange, and the generated liquid may be attached to an inner wall of the pipeline of the second heat exchanger A46. Since the liquid working fluid (such as water) condensed on the inner wall is not a good heat conductor, the liquid working fluid may block the heat conduction between the working vapor and the inner wall of the pipeline of the second heat exchanger A46, thereby reducing the efficiency of heat exchange between the working vapor A21 and the aqueous liquid A45 at the second heat exchanger A46.

At the same time, when the aqueous liquid A45 absorbs the heat of the working fluid A21 inside the second heat exchanger A46 so as to be vaporized, steam bubbles may be formed, and the bubbles may be attached to surfaces of fins and an outer wall of the pipeline of the second heat exchanger A46. Since the steam bubbles are not good heat conductors, the steam bubbles may block the heat conduction between the aqueous liquid A45 and the working fluid A21 at the second heat exchanger A46, thereby reducing the heat exchange efficiency of the second heat exchanger A46.

It can be seen that the heat exchange efficiency in the above example is not very ideal, and there is room for improvement. In addition, the first heat exchanger A6, a valve A24, a compressor A22 and the second heat exchanger A46 are connected to one another via pipelines to form a permanent closed flow path, and only water and steam exist in the flow path. When the device is at rest, the device may be cooled to room temperature. At this time, the steam in the closed flow path may be condensed into water, and the pressure inside the closed flow path may drop to near vacuum. This may result in that each part forming the closed flow path and a connecting member thereof need to withstand a pressure of about 1 BAR from the atmosphere for a long time when the device is at rest. This pressure is likely to damage the reliability and stability of device components, so that requirements for performance of the components are increased at delivery, and the cost of the device is thus increased.

SUMMARY

An objective of the present application is to provide a heat exchange device, which can effectively solve the above problems to significantly improve the energy recovery efficiency, can reduce the damage of atmospheric pressure to the device to improve the reliability and stability of the device and prolong the service life of the device, and is convenient to use.

According to a first aspect of the present application, there is provided an energy transmission device (1) comprising: a first fluid path including a first channel and a second channel for a first fluid 35) to flow therein; a compressor (11) positioned between the first channel and the second channel and configured to compress the first fluid in the vapor state (35B); a regulating valve (12) positioned between the first channel and the second channel location distinct from the compressor (11); a first heat exchanger (21) formed at least partially by the first channel for facilitating release of heat energy from the first fluid (35B) flowing in a vapor state; a second heat exchanger (31) formed at least partially by the second channel for facilitating absorption of heat energy by the first fluid (35A) flowing in a liquid state; a first flow guide structure (219) arranged within the first heat exchanger (21) for promoting the spiral flow of the first fluid (35B) in the vapor state; and a second flow guide structure (320) arranged within the second heat exchanger (31) for promoting the spiral flow of the first fluid (35A) in the liquid state; wherein the first fluid path is sealed during energy transmission; wherein the compressor (11) and the regulating valve (12) are configured to adjust a pressure in the first channel and a pressure in the second channel such that the first channel and the second channel have different pressures during the operation of the energy transmission device; and wherein at least one of the first flow guide structure (219) and the second flow guide structure (320) is movable. Preferably, the energy transmission device of claim 1, further comprising a second fluid path for a second fluid (36A, 36B) to flow, wherein the first fluid path intersects in non-fluid communication with the second fluid path at the first heat exchanger (21) and the second heat exchanger (31), and the energy transmission device is configured such that when flowing through the first heat exchanger (21), the vaporous first fluid (35B) exchanges heat with a second fluid in liquid state (36A) in the second fluid path, so that at least a part of the second fluid in liquid state (36A) and at least a part of the vaporous first fluid (35B) changes state; and when flowing through the second heat exchanger (31), the first fluid in liquid state (35A) exchanges heat with the vaporous second fluid (36B), so that at least a part of the first fluid in liquid state (35A) and at least a part of the vaporous second fluid (36B) changes state. Preferably, at least a part of the second flow guide structure (320) is adjacent to an inner wall of the second channel forming the second heat exchanger (31), and a spiral channel is formed along the inner wall; and/or at least a part of the first flow guide structure (219) is adjacent to an outer wall of-heat exchanger (21), and a spiral channel is formed along the outer wall.

According to a second aspect of the present application, there is provided a heat exchange device (21,31) for exchanging heat between a vaporous first fluid (35B/36B) and a second fluid in liquid state (36A, 35A) comprising: a first heat exchange channel (211/311) for a vaporous first fluid (35B/36B) to flow and releases heat; a second heat exchange channel (212/312) for a second fluid in liquid state (36A/35A) to flow and absorbs heat; a first flow guide structure (219/319) for facilitating spiral flow of the vaporous first fluid (35B/36B) around the second heat exchange channel; and a second flow guide structure (220/320) for facilitating spiral flow of the second fluid in liquid state (36A/35A) in the second heat exchange channel, wherein at least one of the first flow guide structure (219/319) and the second flow guide structure (220/320) is movable, and wherein the heat exchange device is configured so that, during heat exchange, at least a part of the vaporous first fluid (35B/36B) and at least a part of the second fluid in liquid state (36A, 35A) changes state. Preferably, at least a part of the first flow guide structure (219/319) is adjacent to tan outer wall of the second heat exchange channel (212/312) and a spiral channel is formed along the outer wall; and/or at least a part of the second flow guide structure (220/320) is adjacent to an inner wall of the second heat exchange channel (212/312), and a spiral channel is formed along the inner wall. Preferably, the energy transmission device (1) comprising the heat exchange device (21) of the second aspect of the present application further comprises a first fluid path for a vaporous first fluid (35B) and a first fluid in liquid state (35A) to flow, wherein the first fluid path includes a first channel and a second channel; a compressor (11) positioned between the first channel and the second channel and configured to compress a vaporous first fluid (35B); a regulating valve (12) positioned between the first channel and the second channel at a location distinct from the compressor (11); wherein the first heat exchange channel (211) is formed by at least a part of the first channel; and wherein at least a part of the second channel a third heat exchange channel (312) for a first fluid in liquid state (35A) to flow and absorbs heat; and wherein the first fluid path is sealed during energy transmission; and wherein the compressor (11) and the regulating valve (12) are configured to adjust a pressure in the first channel and a pressure in the second channel such that the first channel and the second channel are in different pressures during the operation of the energy transmission device; and wherein the energy transmission device is configured to transmit heat energy from the third heat exchange channel (312) to the second heat exchange channel (212). Preferably, the energy transmission device (1) further comprises a second fluid path for a vaporous second fluid (36B) and a second fluid in liquid state (36A/36C) to flow, wherein the second fluid intersects in non-fluid communication with the first fluid path, and wherein the second heat exchange channel (212) is formed by at least a part of the second fluid path; and wherein the second fluid path further forms a fourth heat exchange channel (311) for a vaporous second fluid (36B) to flow and releases heat to a first fluid in liquid state (35A; and wherein when flowing through the third and the fourth heat exchange, at least a part of the first fluid in liquid state (35A) and at least a part of the vaporous second fluid (36B) changes state. Preferably, a third flow guide structure (320) for facilitating spiral flow of the first fluid in liquid state (35A) is arranged in the third heat exchange channel (312), and/or a fourth flow guide structure (319) for facilitating spiral flow of the vaporous second fluid (36B) is arranged in the fourth heat exchange channel (311). Preferably, the energy transmission device (1) comprising the heat exchange device (31) of the second aspect of the present application further comprises a first fluid path for a second fluid in liquid state (35A) and a vaporous second fluid (35B) to flow, wherein the first fluid path includes a first channel and a second channel; a compressor (11) positioned between the first channel and the second channel and configured to compress a vaporous second fluid (35B); a regulating valve (12) positioned between the first channel and the second channel at a location distinct from the compressor (11); wherein the second heat exchange channel (312) is formed by at least a part of the second channel; and wherein at least a part of the first channel forms a third heat exchange channel (211) for a vaporous second fluid (35B) to flow and releases heat; and wherein the first fluid path is sealed during energy transmission; and wherein the compressor (11) and the regulating valve (12) are configured to adjust a pressure in the first channel and a pressure in the second channel such that the first channel and the second channel are in different pressures during the operation of the energy transmission device; and wherein the energy transmission device is configured to transmit heat energy from the first heat exchange channel (311) to the third heat exchange channel (211). Preferably, the energy transmission device (1) further comprises a second fluid path for a vaporous first fluid (36B) and a first fluid in liquid state (36A/36C) to flow, wherein the second fluid path intersects in non-fluid communication with the first fluid path, and wherein the first heat exchange channel (311) is formed by at least a part of the second fluid path; and wherein the second fluid path further forms a fourth heat exchange channel (212) for a first fluid in liquid state (36A) to flow and absorbs heat from a vaporous second fluid (35B) in the third heat exchange channel (211); and wherein when flowing through the third and the fourth heat exchange channel, at least a part of the vaporous second fluid (35B), and at least a part of the first fluid in liquid state (36A) changes state. Preferably, the energy transmission device, further comprising a third flow guide structure (219) for facilitating spiral flow of the vaporous second fluid (35B) in the third heat exchange channel (211) and/or a fourth flow guide structure (220) for facilitating spiral flow of the first fluid in liquid state (36A) in the fourth heat exchange channel (212).

Preferably, the first fluid path is capable of being in fluid communication with the outside by selectively opening a first valve (222); and/or wherein the energy transmission device further comprising a first heating device (318), configured to heat and vaporize a liquid (35A) in the first fluid path; and/or wherein the first valve is in an open state when the first heating device (318) is vaporizing the liquid (35A) therein.

Preferably, the energy transmission device further comprises a fluid delivery device (213/314) for facilitating circulation of a vaporous fluid (35B) inside the first channel; or for facilitating circulation of a fluid in liquid state (35A) inside the second channel.

Preferably, the energy transmission device further comprises a first chamber (315) located in the second channel and configured to contain a fluid in liquid state (35A) therein, and a second chamber (322) for collecting and containing a fluid in liquid state (36C) formed by condensation of a vaporous fluid (36B) in the second fluid path, wherein the first chamber (315) and the second chamber (322) is capable of being in fluid communication by opening a second valve (603).

The principles, characteristics, features, advantages, etc. of various technical solutions according to the present application will be clearly understood from the following detailed description with reference to the accompanying drawings. For example, compared with the prior art, the technical solutions of the present application are easy to manufacture, mount and maintain, are low in use cost, overcome an adverse impact of condensation, and can effectively ensure and improve the working performance, safety and reliability of the device. The present application is of significant utility.

BRIEF DESCRIPTION OF THE DRAWINGS

The technical solutions of the present application will be further described in detail with reference to the accompanying drawings and embodiments, but these accompanying drawings are only provided for the purpose of explanation, and are only intended to conceptually illustrate the structural configurations herein, which are not necessarily manufactured to scale.

The basic configuration of the present application will be exemplified below with reference to the accompanying drawings, in which.

DETAILED DESCRIPTION

First, it should be noted that the structural composition, characteristics, advantages, etc. of an energy transmission device according to the present application will be described in detail below by way of example. However, all descriptions are only for illustration and do not constitute any restrictions on the present application. The technical terms "first" and "second" herein are only used for the purpose of distinguishing expression, and are not intended to indicate their order and relative importance. The technical term "connecting (or connected, etc.)" covers the direct and/or indirect connection of a specific component to another component. The technical term "substantially" is intended to include insubstantial errors associated with the measurement of a specific quantity. The technical terms such as "upper", "lower", "top", "bottom", "inner", "outer" and derivatives thereof, etc. should be related to the orientations in the accompanying drawings, and various alternative orientations may be used in the present application unless expressly indicated otherwise.

In addition, for any single technical feature described or implied in the embodiments mentioned herein, the present application still allows for any combination or deletion between these technical features (or equivalents thereof), so as to obtain more other embodiments of the present application that may not be directly mentioned herein. In addition, in order to simplify the drawings, the same or similar parts and features may be marked only in one or several places in the same drawing.

Various embodiments of a heat exchange device, an energy transmission device and a liquid heating device according to the present application will be described below by way of example with reference to the accompanying drawings. It should be understood that the present application is not limited thereto. In the accompanying drawings, the same reference signs are used for the same members.

It should be understood by those skilled in the art that the heat exchange device and the energy transmission device according to the present application may also use a fluid other than water as a working fluid, and can be applied in different scenarios, such as a condensation device in a large factory, a vehicle device, a refrigeration device, etc.

Figure 1:
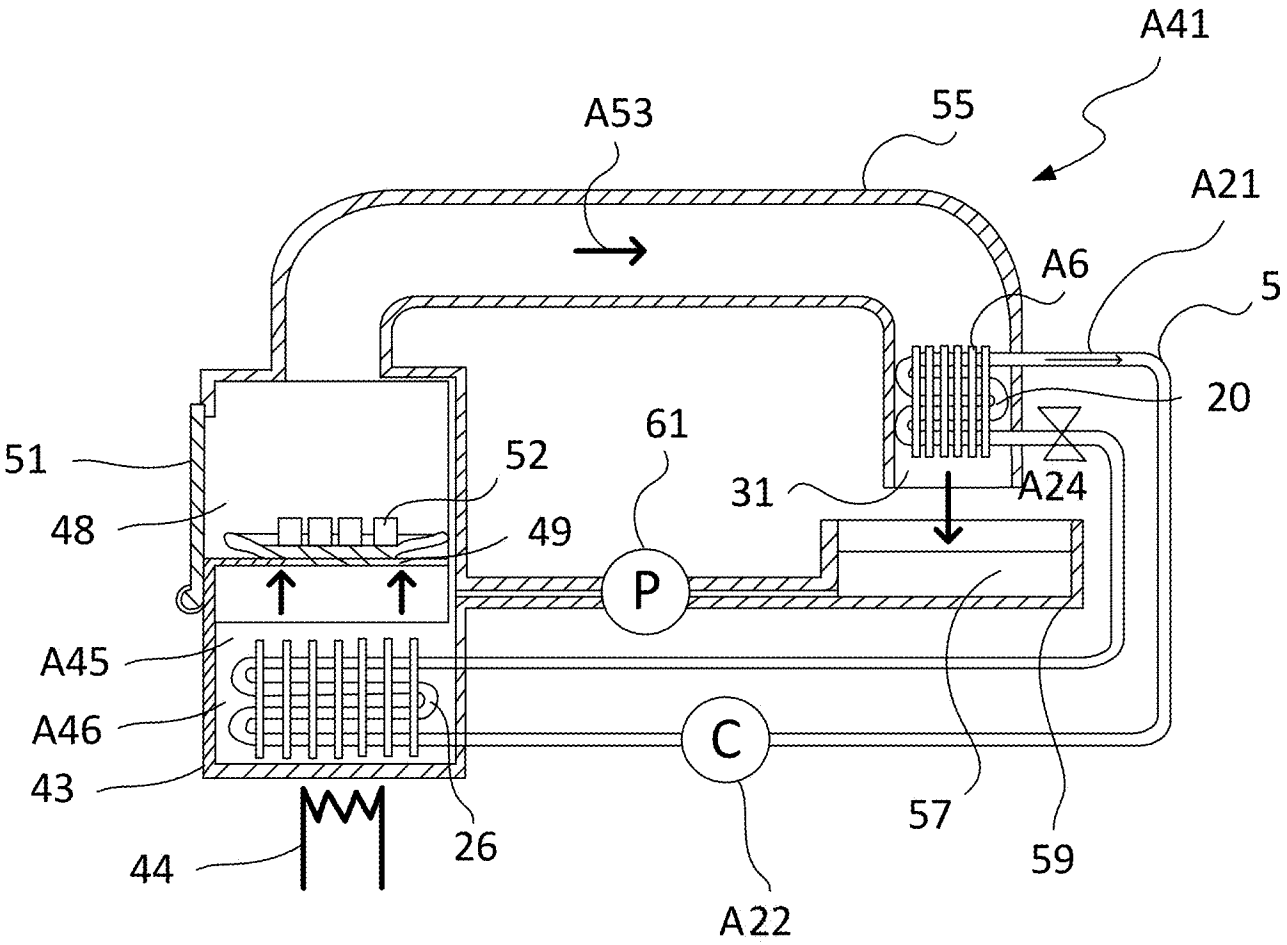
FIG. 1 shows an energy transmission in the prior art.
Figure 2:
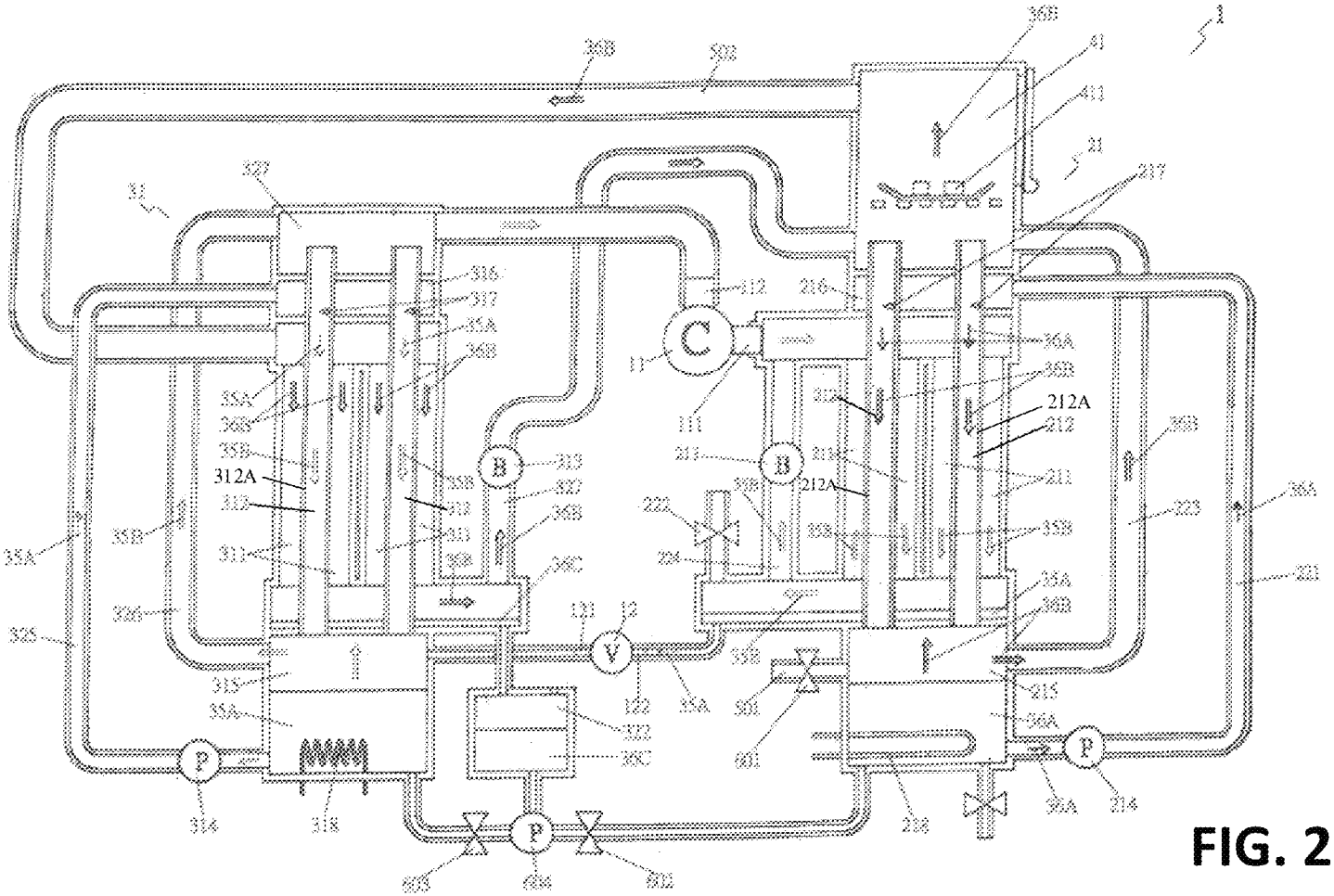
FIG. 2 is a schematic structural diagram of an energy transmission device according to an embodiment of the present application.

In order to improve the efficiency of an energy transmission device in the prior art and reduce its production cost, a first embodiment of the present application provides an energy transmission device. As shown in FIG. 2, the energy transmission device 1 includes a first fluid path at least for a first fluid 35 to pass through and a second fluid path for a second fluid 36 to pass through. The first fluid path and the second fluid path intersect in at least two places but are not in fluid communication with each other. The first fluid 35 and the second fluid 36 exchange heat at the intersections, so that at least a part of the first fluid 35 and at least a part of the second fluid 36 have a change in state at the same time, such as evaporating from a liquid state into a vaporous state or condensing from a vaporous state into a liquid state. The first intersection is a first heat exchanger 21, and the second intersection is a second heat exchanger 31.

As shown in FIG. 2, in the first fluid path, the working fluid 35 passes through different parts in different states. In this process, the working fluid 35 is in different states, such as a liquid state or a vaporous state, due to heat absorption or heat release.

The configuration and function of the first fluid path will be described in detail below in combination with the running direction of the working fluid 35. It should be noted that it is not necessary to include all the components described herein in order to achieve the technical objectives of the present application. The components described herein are only for the purpose of demonstrative description. According to different application scenarios, those skilled in the art should be able to increase or reduce components herein, or replace several components with equivalent ones.

Figure 3:
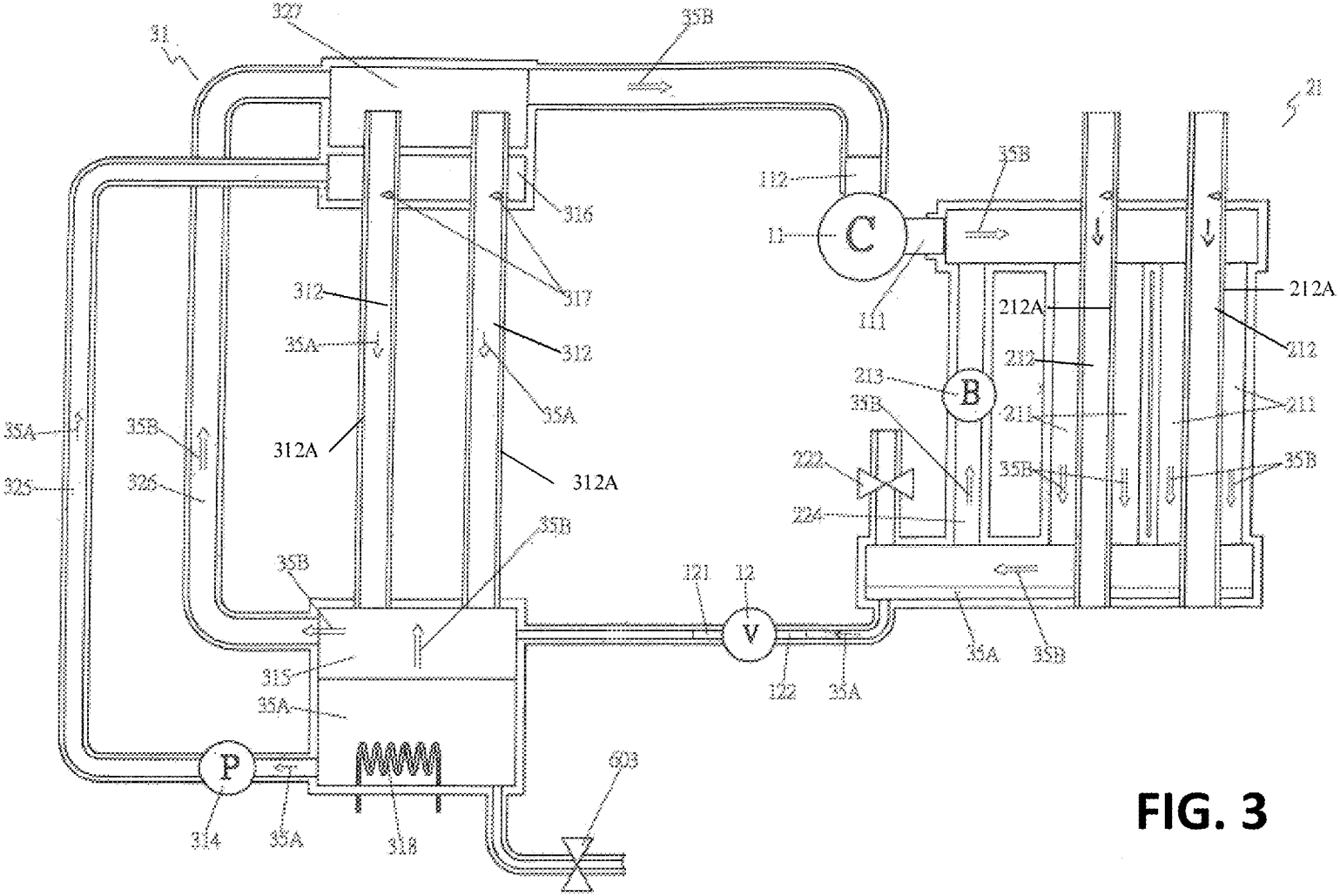
FIG. 3 is a schematic diagram of a first fluid path in the energy transmission device shown in FIG. 2.

First, as shown in FIG. 3, a first fluid path in the device according to the present application is divided into an evaporation section (first channel) and a condensation section (second channel). The evaporation section is located between the outlet 111 of a compressor 11 and the Inlet 122 of a regulating valve 12; the condensation section is located between the outlet 121 of the regulating valve 12 and the inlet 112 of the compressor 11.

The condensation section includes a working liquid storage chamber 315 configured to store a working fluid in a liquid state, i.e., a working liquid 35A. A heater 318 is arranged in the working liquid storage chamber 315, and is configured to heat the working liquid 35A to vaporize the working liquid into a vaporous working fluid, i.e., a working vapor 35B. A fluid channel 326 is connected to the working liquid storage chamber 315, such that the working vapor 35B passes through the fluid channel to enter a chamber-327. The chamber 327 is in communication with a compressor 11, so that the working vapor 35B may enter the evaporation section after being compressed by the compressor 11. At the same time, the working liquid storage chamber 315 is further in communication with a fluid delivery device (pump) 314 through a pipeline. The working fluid delivery device 314 is configured to circulate the working liquid 35A within the condensation section. The working fluid delivery device 314 is in fluid communication with a working liquid flow dividing chamber 316 through a fluid channel 325, and is configured to deliver the working liquid 35A from the working liquid storage chamber 315 to the working liquid flow dividing chamber 316 through the channel 325. The working liquid flow dividing chamber 316 is in communication with a plurality of working liquid channels 312 formed by the inner cavities of a plurality of condenser tubes 312A through a plurality of flow dividing holes 317. The working liquid 35A may enter the working liquid channels 312 through the flow dividing holes 317 and flow downwardly to finally enter the storage chamber 315. The working liquid 35A exchanges heat with the outside when passing through the working liquid channels 312.

Second, the compressor 11 located in the first fluid path has an outlet 111 and an inlet 112, the inlet 112 of the compressor is in fluid communication with the chamber 327 through a pipeline, and the outlet 111 is connected to a plurality of working vapor channels 211 via a working vapor flow dividing chamber. Each working vapor channel 211 is configured to allow the working vapor 35B to pass through while facilitating the heat exchange between the working vapor 35B and the outside. A chamber for temporarily storing the working liquid 35A formed by condensation after heat exchange is provided below the working vapor channels 211, and the chamber delivers the working liquid 35A back to the storage chamber 315 through a pipeline and a regulating valve 12.

Finally, as a preferred embodiment, a working fluid delivery device 213 is further arranged in the first fluid path, and is configured to circulate the working vapor (35B) within the evaporation section to cause part of the working vapor 35B not condensed in the working vapor channel 211 to enter the working vapor channel 211 again through a channel 224 and flow across the outer walls of the evaporator tubes 212A without significantly compressing the working vapor 35B, so as to perform heat exchange again. At the same time, the working fluid delivery device 213 can further increase a flow speed of the working vapor 35B, so that the working vapor 35B flows across the outer wall of the evaporator tubes 212A at an accelerated speed, so as to improve the heat exchange efficiency.

In a preferred embodiment of the present application, when heat exchange is being performed, a first valve 222 and a second valve 603 are closed, and the first fluid path is formed as a sealed loop.

As shown in FIG. 2, in the second fluid path, tap water 36 passes through different parts in different states. In this process, the tap water 36 is in different states, such as a liquid state (36A, 36C) or a vaporous state (36B), due to heat absorption or heat release.

The configuration and function of the second fluid path will be described in detail below in combination with the running direction of the tap water 36. It should be noted that it is not necessary to include all the components described herein in order to achieve the technical objectives of the present application. The components described herein are only for the purpose of demonstrative description. According to different application scenarios, those skilled in the art should be able to increase or reduce components herein, or replace several components with equivalent ones.

The second fluid path according to the present application includes a tap water storage chamber 215 connected to a tap water source via a valve 601 and a pipeline 501 to receive tap water 36A. A heater 218 is arranged in the tap water storage chamber 215, and is configured to heat the tap water 36A to vaporize the tap water, that is, turning the tap water 36A into steam 36B. A fluid channel 223 is connected to the tap water storage chamber 215, such that the steam 36B passes through the fluid channel to enter a steaming chamber 41. An object 411 to be steamed is provided in the steaming chamber 41. The steaming chamber 41 is connected to the steam channels 311 via a channel 502.

The steam channels 311 intersects with the condenser tubes is 312A in the first fluid path, but is not in fluid communication with a plurality of working liquid channels 312 formed by the inner cavities of the condenser tubes 312A, instead is in fluid isolation therefrom. An exemplary configuration is that a plurality of condenser tubes 312A are arranged in the steam channels 311, so that the steam channels 311 includes and encircles the plurality of condenser tubes 312A. Preferably, the plurality of condenser tubes 312A and the steam channels 311 are arranged in a vertical direction to facilitate the flow of steam and a working liquid. The steam channels 311 are connected to a steam delivery device (Blower) 313 via a pipeline. The steam delivery device 313 is in communication with the steaming chamber 41 through a pipeline, and can deliver the steam 36B that is not condensed in the steam channels 311 into the steaming chamber 41 through a channel 327 so as to heat the object 411 to be steamed without significantly compressing the steam 36B, while excess steam 36B enters the steam channels 311 again through the channel 502.

At the same time, the tap water storage chamber 215 is further in communication with a tap water delivery device (Pump) 214 through a pipeline. The tap water delivery device 214 is in fluid communication with a tap water flow dividing chamber 216 through a fluid channel 221, and is configured to deliver the tap water 36A from the tap water storage chamber 215 to the tap water flow dividing chamber 216 through the channel 221. The tap water flow dividing chamber 216 is in communication with a plurality of tap water channels 212 formed by the inner cavities of the evaporator tubes 212A through a plurality of flow dividing holes 217. The tap water 36A may enter the tap water channels 212 through the flow dividing holes 317 and flows downwardly to finally enter the tap water storage chamber 215. The tap water 36A exchanges heat with the working vapor 35B when passing through the tap water channels 212.

The tap water channels 212 intersects with the working vapor channels 211 in the first fluid path, but is not in fluid communication with the working vapor channels (211), instead is in fluid isolation therefrom. An exemplary configuration is that a plurality of evaporator tubes 212A are arranged in the working vapor channels 211, so that the working vapor channels 211 includes and encircles the plurality of evaporator tubes 212A. Preferably, the plurality of evaporator tubes 212A and the working vapor channels 211 are arranged in a vertical direction to facilitate flow of the tap water and the working vapor.

Preferably, the second fluid path further has a distilled water storage chamber 322, which is in fluid communication with the steam channels 311 and is configured to collect condensed distilled water 36C. A distilled water pump 604 is connected to the distilled water storage chamber 322, and is configured to pump the distilled water 36C to the tap water storage chamber(s) 215 and/or working liquid storage chamber 315 through valves 602 and 603, respectively.

The device according to the present application has been described above with the combination of the fluid paths and the fluids. The structure of the energy transmission device according to the present application and its operating mode will be further described below in the form of a functional module structure with the structure shown in the accompanying drawings. In an exemplary embodiment, as shown in FIG. 2, the energy transmission device 1 is a steaming device that heats tap water 36A into steam 36B to heat an object (such as food) 411. The energy transmission device 1 includes a compressor 11, a regulating valve 12, an evaporation heat exchanger 21, a condensation heat exchanger 31, a steaming chamber 41, and a number of fluid delivery pipelines. The compressor 11 has an outlet 111 and an inlet 112, and the regulating valve 12 has an outlet 121 and an inlet 122. The evaporation heat exchanger 21 is configured to exchange heat between the tap water 36A and a working vapor 35B which flow through fluid channels that are not in communication with each other, so that the tap water 36A is evaporated into steam 36B while the working vapor 35B in the other fluid channel is condensed into a working liquid 35A. The condensation heat exchanger 31 is configured to exchange heat between the steam 36B and the working vapor 35A which flow through fluid channels that are not in communication with each other, so that the steam 36B is condensed into distilled water 36C while the working liquid 35A absorbs heat from the steam 36B to become the working vapor 35B. A first valve 222 may be selectively closed or opened as required. The steaming chamber 41 is an exemplary application scenario. For example, the steaming chamber may be configured to place the object 411 to be steamed. Exemplarily, the energy transmission device 1 uses steam and liquid water (e.g., pure water) as working fluids, hereinafter referred to as a working liquid 35A and a working vapor 35B.

The evaporation heat exchanger 21 includes a plurality of working vapor channels 211, a plurality tap water channels 212 formed by the inner cavities of a plurality of evaporator tubes 212A, a tap water storage chamber 215, a tap water flow dividing chamber 216, a tap water delivery device 214, a heating device 218, and a working fluid delivery device 213. Each evaporation tube 212A is made of a good heat conductor such as a metal, and is configured for tap water 36A (and steam 36B) to pass through. Each evaporation tube 212A is arranged in a substantially vertical form and has a uniform circular cross-section along its length. The working vapor channels 211 are configured for the working vapor 35B (and the working liquid 35A) to pass through, and are arranged to surround each evaporator tube 212A. The working fluid delivery device (such as a Blower) 213 is configured to facilitate the flow of the working vapor 35B.

The condensation heat exchanger 31 includes a plurality of steam channels 311, a plurality of working liquid channels 312 formed by the inner cavities of a plurality of condenser tubes 312A, a working liquid storage chamber 315, a working liquid flow dividing chamber 316, a working fluid delivery device 314, a heating device 318, and a steam delivery device 313. Each condenser tube 312A is also made of a good heat conductor such as a metal, and is configured for the working liquid 35A (and the working vapor 35B) to pass through. Each condensation tube 312A is arranged in a substantially vertical form and has a uniform circular cross-section along its length. The steam channels 311 are configured for the steam 36B (and the distilled water 36C) to pass through, and are arranged to surround each condenser tube 312A. The steam delivery device (such as a Blower) 313 is configured to facilitate the flow of the steam 36B.

As shown in FIG. 3, after the first valve 222 and the second valve 603 are closed, the plurality of working vapor channels 211 in the evaporation heat exchanger 21, the working fluid delivery device 213, the regulating valve 12, working liquid channels 312 in the condensation heat exchanger 31, the working liquid storage chamber 315, the working liquid flow dividing chamber 316, the working fluid delivery device (such as a water pump) 314, the compressor 11, etc. are in communication with one another through pipelines and chambers in a sealed manner to form a closed loop (first fluid path) for the working vapor 35B and the working liquid 35A to flow therein.

The closed loop is divided into an evaporation section (first channel) and a condensation section (second channel) by the compressor 11 and the regulating valve 12. Specifically, the evaporation section is formed between the outlet 111 of the compressor and the inlet 122 of the regulating valve in the closed loop, and includes the plurality of working vapor channels 211 and the working fluid delivery device 213. The condensation section is formed between the outlet 121 of the regulating valve and the inlet 112 of the compressor of the closed loop, and includes the working liquid channels 312, the working liquid storage chamber 315, the working liquid flow dividing chamber 316, and the working fluid delivery device 314.

Still referring to FIG. 2, the tap water storage chamber 215 is connected to the water source of tap water via the pipeline 501 to receive the tap water 36A. During use, the tap water enters the tap water storage chamber 215 through the pipeline 501 by opening the valve 601. At this time, the entire steaming device 1 is at room temperature, and the closed loop contains the working vapor 35A, air and a small amount of working gas 35B at room temperature.

Before the steaming device 1 starts to heat the object 411 with steam, the steaming device 1 is preheated. The preheating procedure includes the following operations.

1) The heater 318, the working fluid delivery device 314 (such as a water pump) and the working fluid delivery device 213 (such as a Blower) are activated, and the first valve 222 is opened. The working liquid 35A in the working liquid storage chamber 315 is heated by the heater 318 until the working liquid 35A boils. It should be noted that when the device is set up for the first time, an appropriate amount of pure water 35A must be injected into the working liquid storage chamber 315 in one step so as to be used as a working liquid. Since the first valve 222 has been opened at this time, the loop is in communication with the atmosphere. If the atmospheric pressure is 1 BAR at the time, the working liquid 35A in the working liquid storage chamber 315 boils at 99.6° C., and the working vapor 35B (e.g., steam) with a temperature of 99.6° C. is generated. The working vapor 35B enters a closed loop space formed when the valve 222 is closed, and the air in the space is discharged together with the small amount of working vapor 35B through the first valve 222.
2) The heater 218 is activated to heat the tap water 36A in the tap water storage chamber 215 to 99.6° C. until the tap water boils to generate steam 36B with a temperature of 99.6° C.
3) after a short period of time, the working vapor 35B may completely displace the air from the loop through the first valve 222. At this time, only the working liquid 35A with a temperature of 99.6° C. and the working vapor 35B with a temperature of 99.6° C. exist in the loop.

At this time, the first valve 222 may be closed to form the closed loop, and at the same time, the heater 318 is deactivated while the power of the heater 218 is reduced and the compressor 11 is activated.

As shown in FIG. 3, the compressor 11 in operation delivers the working vapor 35B in the closed loop from the inlet 112 of the compressor to the outlet 111 of the compressor and compresses the working vapor, while the regulating valve 12 restricts or regulates the flow of the working liquid 35A and the working vapor 35B in the closed loop. In this way, 1) pressure in the condensation section is reduced to slightly less than 1 BAR (e.g., 0.9 BAR) and thus the boiling point of the working liquid 35A in the condensation section is reduced to slightly less than 99.6° C. (e.g., 96.7° C.); the working liquid 35A in the working liquid storage chamber 315 in the condensation section, with an original temperature of 99.6° C., boils due to the decrease of the boiling point caused by pressure drop in the condensation section, and a small part of working liquid 35A evaporates into the working vapor 35B with a temperature of 96.7° C.; during evaporation, the working vapor takes away latent heat from the working liquid 35A and reduces the temperature of the working liquid 35A to 96.7° C.; and
2) pressure in the evaporation section increases to slightly greater than 1 BAR (e.g., 1.1 BAR), the condensation temperature of the working vapor 35B in the evaporation section also rises to slightly greater than 99.6° C. (in an embodiment, the condensation temperature rises to 102.3° C.), a small part of the working vapor 35B in the evaporation section is condensed into working liquid drops due to the increase of pressure, and the latent heat released during condensation raises the temperature of the remaining working vapor 35B in the evaporation section to 102.3° C., while the condensed working liquid is also heated to 102.3° C. The condensed working liquid 35A with a temperature of 102.3° C. is collected at the bottom of the evaporation section and enters the condensation section through the regulating valve 12. After entering the condensation section, the working liquid 35A with a temperature of 102.3° C. boils due to the pressure drop, and is cooled to 96.7° C.

Therefore, by adjusting pressures, the compressor 11 and the regulating valve 12 operate to maintain the temperature and the condensation temperature of the working vapor 35B flowing in the evaporation section at 102.3° C. and the temperature and the boiling point of the working liquid 35A flowing in the condensation section at 96.7° C.

The heat exchange process in the evaporation heat exchanger 21 will be explained below with reference to FIGS. 2 and 3.

As shown in FIG. 2, in the evaporation heat exchanger 21, a tap water delivery device 214 delivers tap water 36A with a temperature and a boiling point of 99.6° C. from the tap water storage chamber 215 through the channel 221 to the tap water flow dividing chamber 216 at an upper portion of the evaporator tubes 212A, and enters the tap water channels (212) of through the tap water flow dividing holes 217. The tap water 36A accelerates downward tap water channels 212A due to its own weight. Since the tap water flow dividing holes 217 are narrower than the tap water channels 212, the flow of the tap water 36A does not fill the tap water channels 212, and the tap water flows downwardly against the inner walls of the evaporator tubes 212A to enter the tap water storage chamber 215 again, and is circulated into the tap water channels 212 again by the tap water delivery device 214.

During this period, the tap water 36A with a temperature of 99.6° C. flowing downwardly in the tap water channel 212 absorbs heat from the working vapor 35B with a temperature of 102.3° C. flowing in the working vapor channels 211, so as to be vaporized into steam 36B with a temperature of 99.6° C. At the same time, a part of the working vapor 35B is also condensed into a working liquid 35A with a temperature of 102.3° C. because the heat is being absorbed. The steam 36B with a temperature of 99.6° C. formed in the tap water channel 212, flows downwardly with the tap water 36A to the tap water storage chamber 215, and enters the steaming chamber 41 through the channel 223 to heat the object 411 to be steamed. The excess steam 36B is in communication with the condensation heat exchanger 31 through the channel 502 and enters the steam channels 311 thereof.

The working liquid 35A condensed in the working vapor channel 211 is collected to a lower portion of the evaporation heat exchanger 21, and enters the working liquid storage chamber 315 in the condensation heat exchanger 31 through the regulating valve 12.

The heat exchange process in the condensation heat exchanger 31 will be explained below with reference to FIG. 2.

In the condensation heat exchanger 31, the working fluid delivery device 314 (pump) delivers the working liquid 35A with a temperature and a boiling point of 96.7° C. from the working liquid storage chamber 315 to the working liquid flow dividing chamber 316 at an upper portion of the condenser tubes 312A through the channel 325, and enters working liquid channels (312) through the working liquid flow dividing holes 317. The working liquid 35A accelerates downward in the working liquid channels 312 due to its own weight. Since the working liquid flow dividing holes 317 are narrower than the working liquid channels 312, the flow of the working liquid 35A does not fill the entire working liquid channels 312, and the working liquid flows downwardly against an inner walls of the condenser tubes 312A to enter the working liquid storage chamber 315 again, and is circulated into the working liquid channels 312 again by the working fluid delivery device 314.

During this period, the working liquid 35A with a temperature 96.7° C. flowing downwardly in the working liquid channels 312 absorbs heat from the steam 36B with a temperature of 99.6° C. passing through the steam channels 311, and is vaporized into a working vapor 35B with a temperature of 96.7° C., and the steam 36B is also condensed into distilled water 36C with a temperature of 99.6° C. because the heat thereof is being absorbed. The distilled water 36C is collected and stored in the distilled water storage chamber 322.

The working vapor 35B formed in the working liquid channels 312 flows downwardly to the working liquid storage chamber 315 together with the working liquid 35A, is delivered to the compressor 11 through the channel 326 and the chamber 327, is then compressed by the compressor 11 and enters the evaporation section to start another cycle.

After cooking for a period of time, the tap water 36A in the tap water storage chamber 215 may gradually decrease due to evaporation. At this time, the third valve 602 may be opened and the distilled water pump 604 may be activated to deliver the stored distilled water 36C to the tap water storage chamber 215, so that water can be saved.

When the cooking is completed, the heating devices, the fluid delivery devices and the compressor as shown in FIG. 2 will be deactivated. The device is gradually cooled, the working vapor 35B in the closed loop as shown in FIG. 3 is condensed into the working liquid 35A, and pressure in the closed loop gradually drops. In an embodiment of the present application, the first valve 222 may be opened to allow air to enter the loop at this time, in order to balance the pressure in the loop with the atmospheric pressure. When the device is cooled to room temperature, the first valve 222 may be closed again to reduce the loss of the working liquid 35A. With this configuration of the present application, the internal and external pressures of the device can be substantially the same when the entire device is not running, so that its components do not withstand an additional pressure, thereby prolonging the service life of the device and reducing the maintenance cost.

As mentioned above, since a small amount of working vapor 35B is also discharged when the air in the loop is displaced in each preheating procedure, the working liquid 35A in the working liquid storage chamber 315 may be reduced after the cooking for many times. At this time, the second valve 603 may be opened and a distilled water delivery device (such as a water pump) 604 may be activated, to deliver the stored distilled water 36C into the working liquid storage chamber 315, so that the lost working liquid 35A can be replenished. When an appropriate amount of working liquid 35A is contained in the working liquid storage chamber 315, the second valve 603 may be closed again and the distilled water delivery device 604 may be deactivated again to form a closed loop.

Figure 4A:
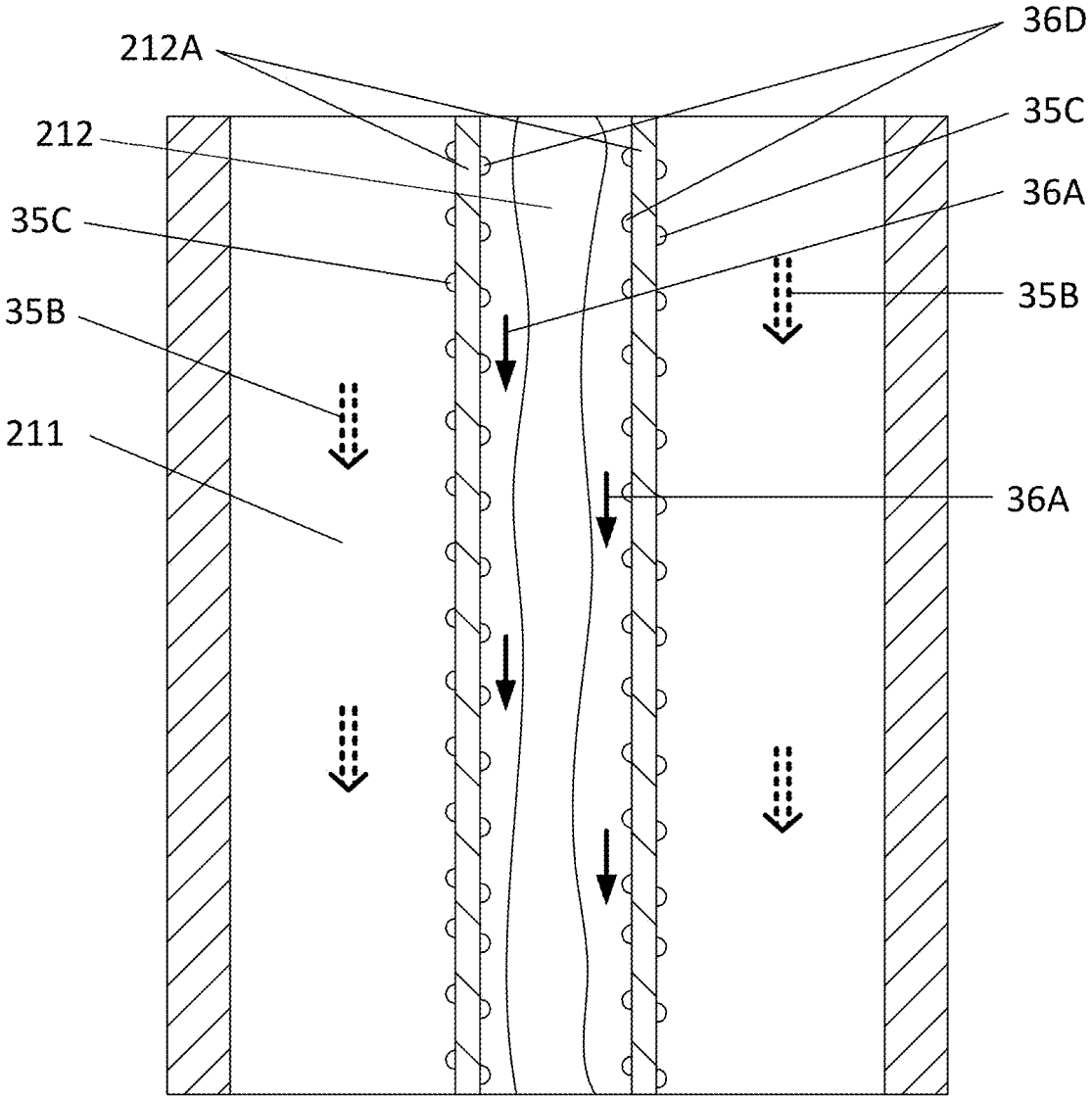
FIG. 4A is a schematic diagram showing heat exchange at a first heat exchanger (21) in the energy transmission device shown in FIG. 2 in the absence of flow guide structures according to the present application.

As shown in FIG. 4A, in the evaporation heat exchanger 21, the working vapor 35B flowing in the working vapor channel 211 and the tap water 36A flowing in the tap water channel 212 are respectively in contact with the inner wall and the outer wall of an evaporator tube 212A and exchange heat through the inner wall and the outer wall. As described in the Background section, fine working liquid drops 35C are first condensed and attached to the outer wall of the evaporator tube 212A, while fine steam bubbles 36D are first formed and attached to the inner wall of the evaporator tube 212A. Since the fine working liquid drops 35C condensed and attached to the outer wall of the evaporator tube 212A are poor heat conductors, a partial contact area between the working vapor 35B and the outer wall of the evaporator tube 212A is reduced, thereby reducing the effect that the working vapor 35B directly outputs heat energy (i.e., latent heat) through the wall of the evaporator tube 212A to the tap water 36A flowing downwardly against the inner wall of the evaporator tube 212A.

Similarly, the fine steam bubbles 36D formed and attached to the inner wall of the evaporator tube 212A are also poor heat conductors, and a partial contact area between the tap water 36A flowing against the inner wall of the evaporator tube 212A and the inner wall of the evaporator tube 212A is thus reduced, thereby reducing the effect that tap water 36A flowing along the inner wall of the evaporator tube 212A directly absorbs heat energy from the working vapor 36B.

Figure 4B:
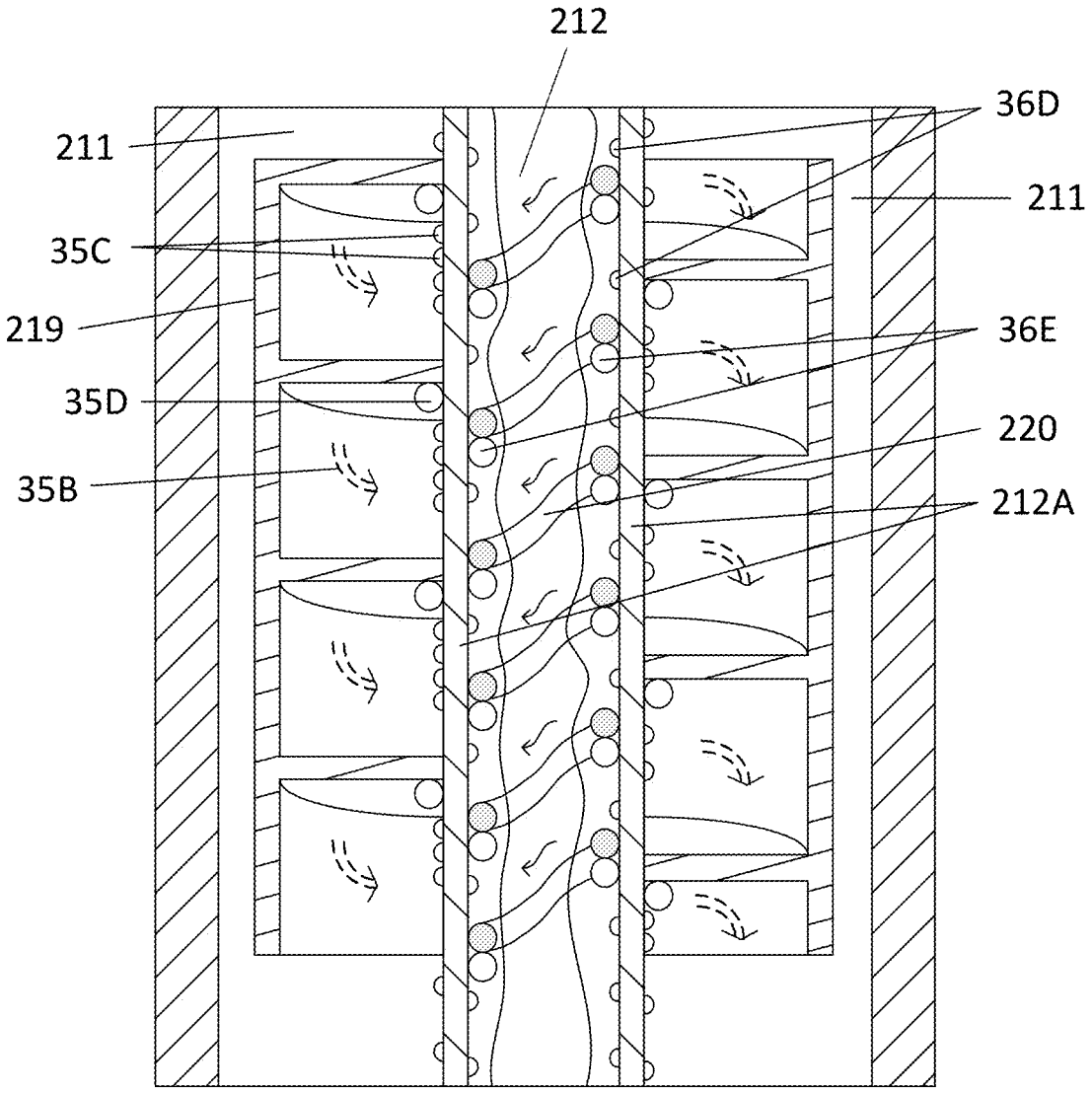
FIG. 4B is a schematic diagram showing heat exchange at a first heat exchanger (21) in the energy transmission device shown in FIG. 2 in the presence of the flow guide structures according to the present application.

In view of the above situation, in order to improve the heat exchange efficiency, in an embodiment of the present application, flow guide structures are arranged inside and outside the evaporator tubes 212A shown in FIGS. 2 and 3. Specifically, as shown in FIG. 4B, in an embodiment of the present application, a working vapor flow guide structure 219 is arranged in a working vapor channel 211. The working gas flow guide structure 219 includes a part adjacent to and spirally extending around the outer wall of the evaporator tube 212A. The working vapor 35B flowing in the working vapor channel 211 flows spirally around the tap water channel 212A because the working vapor is hindered by the working vapor flow guide structure 219, and drives the small working liquid drops 35C to rotate around the evaporator tube 212A, thereby causing the small working liquid drops 35C to accelerate away from the outer wall of the evaporator tube 212A due to a centrifugal force. In this way, the heat exchange effect is significantly improved. Specifically, the working principle herein lies in that the working vapor 35B is configured to spirally flow around the evaporator tube 212A, such that the working vapor drives the small working liquid drops 35C condensed and attached to the outer wall of the evaporator tube 212A to spirally flow around the evaporator tube 212A. Since the density of the working liquid drops 35C is much greater than that of the working vapor 35B, the working liquid drops 35C spirally flowing around the evaporator tube 212A leave the outer wall of the evaporator tube 212A due to a centrifugal force, thereby allowing more working vapor 35B to come into direct contact with the outer wall of the evaporator tube 212A, thereby greatly facilitating the heat conduction and heat exchange between the working vapor 35B and the tap water 36A flowing downwardly along the inner wall of the evaporator tube 212A, improving the amount of output heat energy (latent energy), and improving the heat exchange efficiency.

In another embodiment of the present application, an appropriate driving device (not shown in FIG. 4B) is further added to move the working vapor flow guide structure 219 relative to the evaporator tube 212A, such as reciprocating along the evaporator tube 212A or rotating around the evaporator tube 212A, so as to more efficiently remove the condensed working liquid drops attached to the outer wall. Specifically, when the moving, the part of the working vapor flow guide structure 219 adjacent to the outer wall of the evaporator tube 212A collects the working liquid drops 35C condensed on the outer wall, or scrapes the working liquid drops off, such that there is a larger area of direct contact between the outer wall of the evaporator tube 212A and the working vapor 35B. At the same time, the working liquid drops 35C collected on the working vapor flow guide structure 219 converge into larger-volume working liquid drops 35D, which are more prone to being driven by the spirally flowing working vapor 35B to leave the outer wall of the evaporator tube 212A.

In a preferred embodiment of the present application, a working fluid delivery device 213 (Blower), is arranged in the evaporation section, as shown in FIG. 2 and FIG. 3, so that part of the working vapor 35B that is not condensed in the outer walls of the evaporator tubes 212A passes across the outer wall of the evaporator tubes 212A again through the channel 224 without significantly compressing the working vapor 35B. The working fluid delivery device 213 may further accelerate the working vapor 35B flowing across the outer walls of the evaporator tubes 212A to facilitate heat exchange.

In another preferred embodiment of the present application, a fluid delivery device 213 is used in conjunction with the aforementioned working vapor flow guide structure 219 to accelerate the spirally flowing working vapor 35B, so that the working liquid drops 35C and 35D condensed on the outer wall of the evaporator tubes 212A leave the outer walls of the evaporator tubes 212A faster.

In another preferred embodiment of the present application, a spiral flow guide structure is arranged in the evaporation section. For example, a tap water flow dividing hole 217 is configured such that the tap water 36A flows to one side of the axis of a evaporator tube 212A when flowing out of the flow dividing hole 217, so that the tap water 36A flows spirally downwardly in the tap water channel 212, so as to drive the fine steam bubbles 36D formed on the inner wall of the evaporator tube 212A to spirally flow around the axis of the evaporator tube 212A. Since the density of the tap water 36A is much greater than that of the steam bubbles 36D, the spirally flowing tap water 36A flows tightly against the inner wall of the evaporator tube 212A due to a centrifugal force. Such a flowing easily brings the steam bubbles 36D formed on the inner wall of the evaporator tube 212A in the direction towards the center of the evaporator tube 212A, thus enabling the steam bubbles 36D to more easily leave the inner wall of the evaporator tube 212A. In this way, the tap water 36A can come into direct contact with the inner wall of the evaporator tube 212A in a larger area, that is, the heat exchange area is greatly increased, thereby greatly improving the heat exchange effect.

A further embodiment of the present application provides a tap water flow guide structure 220 arranged in the tap water channel 212, as shown in FIG. 4B, to enhance the spiral flow of the tap water 36A in the tap water channel 212. The flow guide structure 220 includes a part adjacent to the inner wall of the evaporator tube 212A and spirally extending around the axis of the evaporator tube 212A. The tap water 36A flowing in the tap water channel 212 increases the rotation speed due to the effect of the tap water flow guide structure 220, which advantageously drives the fine steam bubbles 36D to rotate around the axis of the evaporator tube 212A at a faster speed. This enables the fine steam bubbles 36D to leave the inner wall of the evaporator tube 212A faster to improve the heat exchange effect.

In another embodiment of the present application, an appropriate driving device (not shown in FIG. 4B) is further added to move the tap water flow guide structure 220 relative to the evaporator tube 212A, such as reciprocating along the evaporator tube 212A or rotating around the axis of the evaporator tube 212A. When moving, the part of the tap water flow guide structure 220 adjacent to the inner wall of the evaporator tube 212A moves the steam bubbles 36D formed on the inner wall of the evaporator pipeline 212A, and collect these steam bubbles onto the tap water flow guide structure 220 for converging into larger-volume steam bubbles 36E. Larger bubbles are more prone to being driven by the spirally flowing tap water 36A to leave the inner wall of the evaporator tube 212A faster, so that the tap water 36A comes into more contact with the inner wall of the evaporator tube 212A to absorb heat energy from the working vapor 35B more effectively.

Figure 5A:
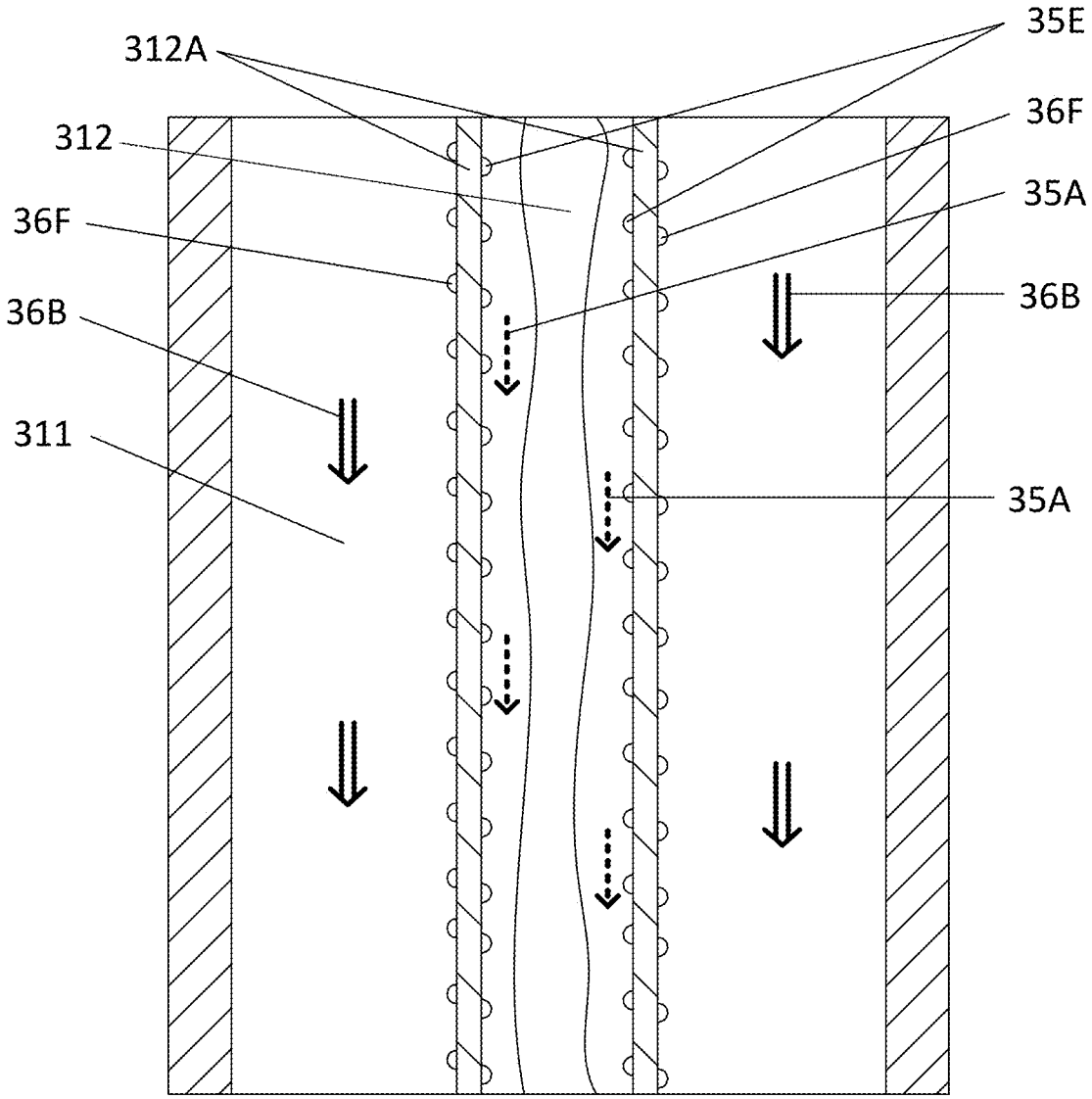
FIG. 5A is a schematic diagram showing heat exchange at a second heat exchanger (31) in the energy transmission device shown in FIG. 2 in the absence of flow guide structures according to the present application.

In the energy transmission device shown in FIG. 2, besides the heat exchanger 21, there is also a heat exchange efficiency problem at the heat exchanger 31. As shown in FIG. 5A, a condenser tube 312A has an outer wall and an inner wall, and the steam 36B flowing in the steam channel 311 and the working liquid 35A flowing in the working liquid channel 312 are respectively in contact with the inner wall and the outer wall and exchanges heat through the inner wall and the outer wall. For the same reason as mentioned above, fine distilled water drops 36F may be condensed and attached to the outer wall of the condenser tube 312A, while fine working vapor bubbles 35E may be formed and attached to the inner wall of the condenser tube 312A. Since the fine distilled water drops 36F condensed and attached to the outer wall of the condenser tube 312A are poor heat conductors, a partial contact area between the steam 36B and the outer wall of the condenser tube 312A is reduced, thereby reducing the effect of heat exchange between the steam 36B and the working liquid 35A flowing downwardly along the inner wall of the condenser tube 312A.

Similarly, the working vapor bubbles 35E formed on the inner wall of the condenser tube 312A are poor heat conductors, and a partial contact area between the downward flowing working liquid 35A and the inner wall of the condenser tube 312A is thus also reduced, thereby reducing the effect of heat exchange between the working liquid 35A flowing along the inner wall of the condenser tube 312A and the steam 36B.

Figure 5B:
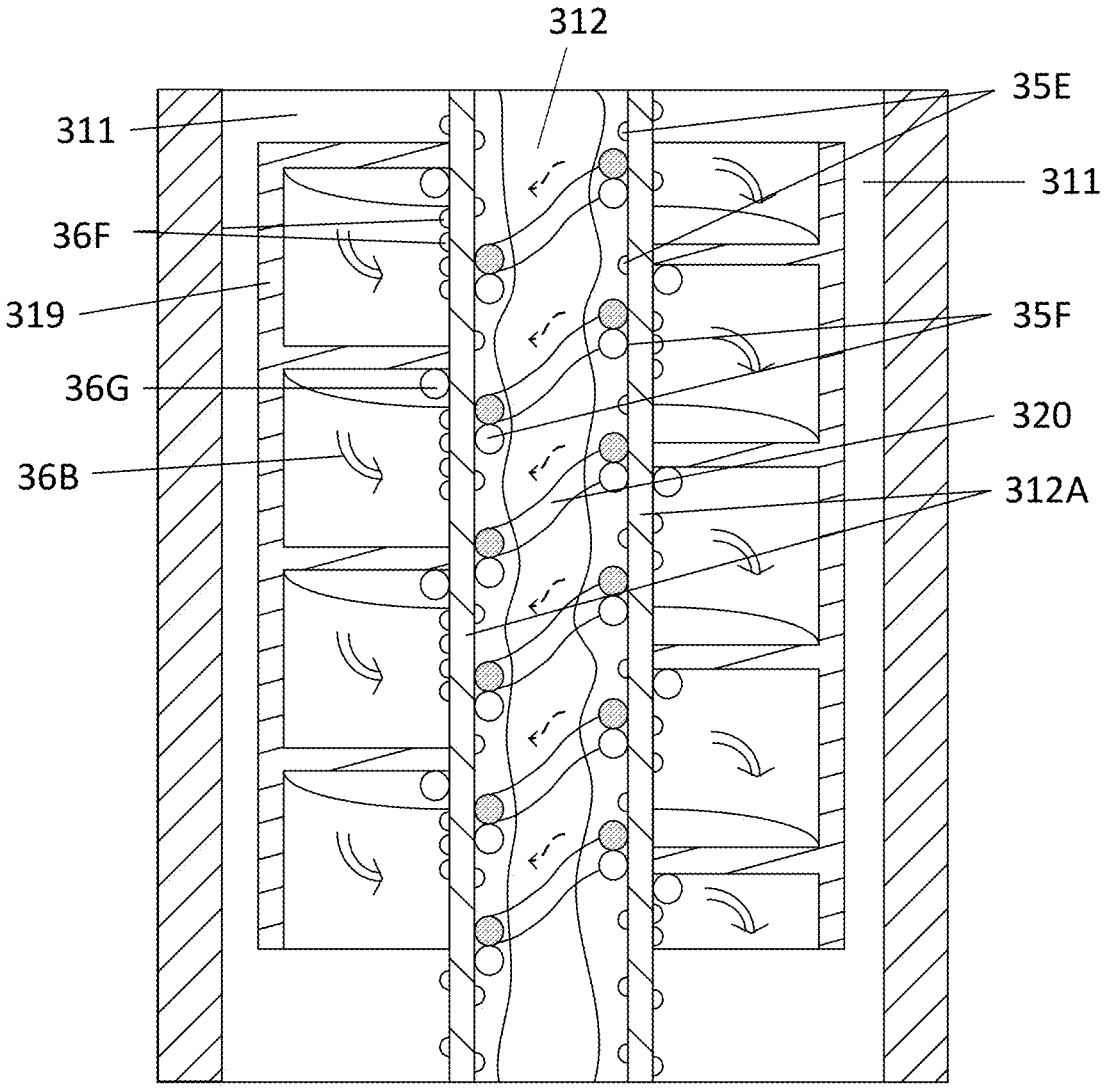
FIG. 5B is a schematic diagram showing heat exchange at a second heat exchanger (31) in the energy transmission device shown in FIG. 2 in the presence of the flow guide structures according to the present application.

In view of the above situation, in order to improve the heat exchange efficiency, in an embodiment of the present application, flow guide structures are arranged inside and outside the condenser tubes 312A shown in FIG. 2. Specifically, in an embodiment of the present application, a steam flow guide structure 319 is arranged in a steam channel 311, as shown in FIG. 5B, to facilitate spiral flow of the steam 36B in the steam channel 311. The steam flow guide structure 319 includes a part adjacent to and spirally extending around the outer wall of the condenser tube 312A. The steam 36B flowing in the steam channel 311 spirally flows around the working liquid channel 312 due to the effect of the steam flow guide structure 319, thereby driving the fine distilled water drops 36F to rotate around the condenser tube 312A. This enables the fine distilled water drops 36F to leave the outer wall of condenser tube 312A faster, so as to improve the heat exchange effect.

The working principle of the steam flow guide structure 319 is as follows. The steam 36B spirally flows around the condenser tube 312A, so that the fine distilled water drops 36F condensed and attached to the outer wall of the condenser tube 312A can be driven to spirally flow around the condenser tube 312A. Since the density of the distilled water drops 36F is much greater than that of the steam 36B, the distilled water drops 36F spirally flowing around the condenser tube 312A leave the outer wall of the condenser tube 312A due to a centrifugal force, thereby allowing more steam 36B to come into direct contact with the outer wall of the condenser tube 312A, and causing the steam 36B to output, in a conductive manner, heat energy (latent energy) to the working liquid 35A flowing downwardly along the inner wall of the condenser tube 312A.

In another embodiment of the present application, an appropriate driving device (not shown in FIG. 5B) is further added to move the steam flow guide structure 319 relative to the condenser tube 312A, such as reciprocating along the condenser tube 312A or rotating around the condenser tube 312A, so as to more efficiently remove the condensed water drops attached to the outer wall. Specifically, when moving, the part of the steam flow guide structure 319 adjacent to the outer wall of the condenser tube 312A collects the distilled water drops 36F, that are condensed and attached to the outer wall of the condenser tube 312A, into the steam flow guide structure 319, so that there is a larger area of direct contact between the outer wall of the condenser tube 312A and the steam 36B. At the same time, the distilled water drops 36F collected to the steam flow guide structure 319 converge into larger-volume distilled water drops 36G, which are more prone to being driven by the spirally flowing steam 36B to leave the outer wall of the condenser tube 312A.

In a preferred embodiment of the present application, a steam delivery device (Blower) 313, is arranged in the condensation heat exchanger 31, as shown in FIG. 2, so that the steam 36B that is not condensed in the steam channels 311 passes through a channel 327 and then passes through the steaming chamber 41 to heat the object 411 to be steamed without significantly compressing the steam 36B, while the excess steam 36B enters the steam channels 311 again through the channel 502. The steam delivery device 313 accelerates the steam 36B flowing across the outer wall of the condenser tubes 312A to facilitate heat exchange.

In another preferred embodiment of the present application, a steam delivery device 313 is used in conjunction with the aforementioned steam flow guide structure 319 to accelerate the spirally flowing steam 36B, which is more helpful to cause the distilled water drops 36F and 36G attached to the outer wall of the condenser tubes 312A to leave the outer wall of the condenser tubes 312A faster.

In another preferred embodiment of the present application, a spiral flow guide structure is arranged in the condensation section. For example, a working liquid flow dividing hole 317 is configured such that the working liquid 35A flows to one side of an axis of a condenser tube 312A when flowing out of the flow dividing hole 317, so that the working liquid 35A flows spirally downwardly in the working liquid channel 312, so as to drive the fine working vapor bubbles 35E formed on the inner wall of the condenser tube 312A to spirally flow around the axis of the condenser tube 312A. Since the density of the working liquid 35A is much greater than that of the working vapor bubbles 35E, the spirally flowing working liquid 35A tightly attached to the inner wall of the condenser tube 312A due to a centrifugal force, and brings the working vapor bubbles 35E formed on the inner wall of the condenser tube 312A in a direction towards the center of the condenser tube 312A. This enables the working vapor bubbles 35E to leave the inner wall of the condenser tube 312A more easily. In this way, the working liquid 35A can come into direct contact with the inner wall of the condenser tube 312A in a larger area, that is, the heat exchange area is greatly increased, thereby greatly improving the heat exchange effect.

A further embodiment of the present application provides a working liquid flow guide structure 320 arranged in the working liquid channel 312, as shown in FIG. 5B, to enhance the spiral flow of the working liquid 35A in the working liquid channel 312. The working liquid flow guide structure 320 includes a part adjacent to the inner wall of the condenser tube 312A and spirally extending around the axis of the condenser tube 312A. The working liquid 35A flowing in the condenser tube 312A increases the rotation speed due to the effect of the working liquid flow guide structure 320, thereby driving the fine working vapor bubbles 35E to rotate around the axis of the condenser tube 312A at a faster speed. This enables the fine working vapor bubbles 35E to leave the inner wall of the condenser tube 312A faster to improve the heat exchange effect.

In another embodiment of the present application, an appropriate driving device (not shown in FIG. 5B) is further added to move the working liquid flow guide structure 320 relative to the condenser tube 312A, such as reciprocating along the condenser tube 312A or rotating around the axis of the condenser tube 312A. When moving, the part of the working liquid flow guide structure 320 adjacent to the inner wall of the condenser tube 312A moves the working vapor bubbles 35E formed on the inner wall of the condenser tube 312A, and collect the working vapor bubbles 35E onto the working liquid flow guide structure 320 for converging into larger-volume working vapor bubbles 35F. Since larger bubbles are more prone to being driven by the spirally flowing working liquid 35A to leave the inner wall of the condenser tube 312A, so that the working liquid 35A comes into more contact with the inner wall of the condenser tube 312A to absorb heat energy from the steam 36B more effectively.

It should be understood that in the above energy transmission device taking the steaming device 1 as an example, during steaming of an object, the working liquid 35A in condensation section (second channel) of the sealed loop absorbs heat, at the condensation heat exchanger 31, from the external steam 36B (outside the sealed loop) so as to be vaporized into the working vapor 35B and condenses the external steam 36B into distilled water 36C. At the same time, during the steaming of the object, the working vapor 35B in the evaporation section (first channel) of sealed loop releases heat, at the evaporation heat exchanger 21, to the external tap water 36A so as to be condensed into the working liquid 35A, and vaporized the external tap water 36A into steam 35B. It should be understood that the energy transmission device according to the present application is not limited to the steaming device, but may also be used in other applications where heat exchange exists.

An exemplary embodiment of the present application provides a heat exchange device (21, 31) configured to condense a first vapor (35B, 36B) into a first liquid (35A, 36C) and vaporized a second liquid (36A, 35A) into a second vapor (36B, 35B). The heat exchange device includes a first vapor channel (211, 311) for the first vapor to pass through and a second liquid channel (212, 312) for the second liquid to pass through. The second liquid channel is formed by the inner cavity of at least one first tube (212A, 312A) having an inner wall and an outer wall, wherein the first vapor flows across the outer wall of the first tube, the second liquid flows across the inner wall of the first tube, and a first vapor flow guide structure (219, 319) that facilitates the spiral flow of the first vapor around the second liquid channel (212, 312) is arranged in the first vapor channel. Preferably, at least a part of the first vapor flow guide structure is arranged around and adjacent to the outer wall of the first tube, wherein when the heat exchange device is in use, the first vapor flow guide structure moves relative to the first tube. Preferably, a second liquid flow guide structure (220, 320) for facilitating the spiral flow of the second liquid is arranged in the second liquid channel (212, 312), wherein the second liquid flow guide structure is arranged spirally around an axis of the first tube and has at least a part adjacent to the inner wall of the first tube; and wherein when the heat exchange device is in use, the second liquid flow guide structure moves relative to the first tube.

A first alternative embodiment of the present application provides exchange device (21,31) for exchanging heat between a vaporous first fluid (35B/36B) and a second fluid in liquid state (36A, 35A) comprising: a first heat exchange channel (211/311) for a vaporous first fluid (35B/36B) to flow and releases heat; a second heat exchange channel (212/312) for a second fluid in liquid state (36A/35A) to flow and absorbs heat; a first flow guide structure (219/319) for facilitating spiral flow of the vaporous first fluid (35B/36B) around the second heat exchange channel; and second flow guide structure (220/320) for facilitating spiral flow of the second fluid in liquid state (36A/35A) in the second heat exchange channel, wherein at least one of the flow guide structure (219/319) and the second flow guide structure (220/320) is movable, and wherein the heat exchange device is configured so that, during heat exchange, at least a part of the vaporous first fluid (35B/36B) and at least a part of the second fluid in liquid state (36A, 35A) changes state.

A second alternative embodiment of the present application provides a heat exchange device (21,31) for exchanging heat between a vaporous first fluid (35B/36B) and a second fluid in liquid state (36A, 35A) comprising: a first heat exchange channel (211/311) for a vaporous first fluid (35B/36B) to flow and releases heat; a second heat exchange channel (212/312) for a second fluid in liquid state (36A/35A) to flow and absorbs heat; a first flow guide structure (219/319) for facilitating spiral flow of the vaporous first fluid (35B/36B) around the second exchange channel; and a second flow guide structure (220/320) for facilitating spiral flow of the second fluid in liquid state (36A/35A) in the second heat exchange channel, wherein at least one of the first flow guide structure (219/319) and the second flow guide structure (220/320) is movable, and wherein the heat exchange device is configured so that, during heat exchange, at least a part of the vaporous first fluid (35B/36B) and at least a part of the second fluid in liquid state (36A, 35A) changes state, wherein at least a part of the first flow guide structure (219/319) is adjacent to an outer wall of the second heat exchange channel (212/312) and a spiral channel is formed along the outer wall; and/or at least a part of the second flow guide structure (220/320) is adjacent to an inner wall of the second heat exchange channel (212/312), and a spiral channel is formed along the inner wall.

A third alternative embodiment of the present application provides an energy transmission device (1) comprising a heat exchange device (21) for exchanging heat between a vaporous first fluid (35B) and a second fluid in liquid state (36A) comprising: a first heat exchange channel (211) for a vaporous first fluid (35B) to flow and releases heat; a second heat exchange channel (212) for a second fluid in liquid state (36A) to flow and absorbs heat; a first flow guide structure (219) for facilitating spiral flow of the vaporous first fluid (35B) around the second heat exchange channel; and a second flow guide structure (220) for facilitating spiral flow of the second fluid in liquid state (36A) in the second heat exchange channel, wherein at least one of the first flow guide structure (219) and the second flow guide structure (220) is movable, and wherein the heat exchange device is configured so that, during heat exchange, at least a part of the porous first fluid (35B) and at least a part of the second fluid in liquid state (36A) changes state, a first fluid path for a vaporous first fluid (35B) and a first fluid in liquid state (35A) to flow, wherein the first fluid path includes a first channel and a second channel; a compressor (11) positioned between the first channel and the second channel and configured to compress a vaporous first fluid (35B); a regulating valve (12) positioned between the first channel and the second channel at a location distinct from the compressor (11); wherein the first heat exchange channel (211) is formed by at least a part of the first channel; and wherein at least a part of the second channel forms a third heat exchange channel (312) for a first fluid in liquid state (35A) to flow and absorbs heat; and wherein the first fluid path is sealed during energy transmission; and wherein the compressor (11) and the regulating valve (12) are configured to adjust a pressure in the first channel and a pressure in the second channel such that the first channel and the second channel are in different pressures during the operation of the energy transmission device; and wherein the energy transmission device is configured to transmit heat energy from the third heat exchange channel (312) to the second heat exchange channel (212). Preferably, the energy transmission device further comprises a second fluid path for a vaporous second fluid (36B) and a second fluid in liquid state (36A/36C) to flow, wherein the second fluid path intersects in non-fluid communication with the first fluid path, and wherein the second heat exchange channel (212) is formed by at least a part of the second fluid path; and wherein the second fluid path further forms a fourth heat exchange channel (311) for a vaporous second fluid (36B) to flow and releases heat to a first fluid in liquid state (35A) in the third heat exchange channel; and wherein when flowing through the third and the fourth heat exchange channel, at least a part of the first fluid in liquid state (35A) and at least a part of the vaporous second fluid (36B) changes state. Preferably, a third flow guide structure (320) for facilitating spiral flow of the first fluid in liquid state (35A) is arranged in the third heat exchange channel (312) and/or a fourth flow guide structure (319) for facilitating spiral flow of the vaporous second fluid (36B) is arranged in the fourth heat exchange channel (311). Preferably, wherein the first fluid path is capable of being in fluid communication with the outside by selectively opening a first valve (222); and/or wherein the energy transmission device further comprising a first heating device (318), configured to heat and vaporize a liquid (35A) in the first fluid path; and/or wherein the first valve is in an open state when the first heating device (318) is vaporizing the fluid (35A) therein. Preferably, the energy transmission device further comprises a fluid delivery device (213/314) for facilitating circulation of a vaporous fluid (35B) inside the first channel; or for facilitating circulation of a fluid in liquid state (35A) inside the second channel.

A fourth alternative embodiment of the present application provides an energy transmission device, comprising a heat exchange device (31) for exchanging heat between a vaporous first fluid (36B) and a second fluid in liquid state (35A) comprising: a first heat exchange channel (311) for a vaporous first fluid (36B) to flow and releases heat; a second heat exchange channel (312) for a second fluid in liquid state (36A/35A) to flow and absorbs heat; a first flow guide structure (319) for facilitating spiral flow of the vaporous first fluid (36B) around the second heat exchange channel; and a second flow guide structure (320) for facilitating spiral flow of the second fluid in liquid state (35A) in the second heat exchange channel, wherein at least one of the first flow guide structure (319) and the second flow guide structure (320) is movable, and wherein the heat exchange device is configured so that, during heat exchange, at least a part of the vaporous first fluid (36B) and at least a part of the second fluid in liquid state (35A) changes state, a first fluid path for a second fluid in liquid state (35A) and a vaporous second fluid (35B) to flow, wherein—the first-fluid path includes a first channel and a second channel; a compressor (11) positioned between the first channel and the second channel and configured to compress a vaporous second fluid (35B); a regulating valve (12) positioned between the first channel and the second channel at a location distinct from the compressor (11); wherein the second heat exchange channel (312) is formed by at least a part of the second channel; and wherein at least a part of the first channel forms a third heat exchange channel (211) for a vaporous second fluid (35B) to flow and releases heat; and wherein the first fluid path is sealed during energy transmission; and wherein the compressor (11) and the regulating valve (12) are configured to adjust a pressure in the first channel and a pressure in the second channel such that the first channel and the second channel are in different pressures during the operation of the energy transmission device; and wherein the energy transmission device is configured to transmit heat energy from the first heat exchange channel (311) to the third heat exchange channel (211). Preferably, the energy transmission device further comprises a second fluid path for a vaporous first fluid (36B) and a first fluid in liquid state (36A/36C) to flow, wherein the second fluid path intersects in non-fluid communication with the first fluid path, and wherein the first heat exchange channel (311) is formed by at least a part of the second fluid path; and wherein the second fluid path further forms a fourth heat exchange channel (212) for a first fluid in liquid state (36A) to flow and absorbs heat from a vaporous second fluid (35B) in the third heat exchange channel (211); and wherein when flowing through the third and the fourth heat exchange channel, at least a part of the vaporous second fluid (35B), and at least a part of the first fluid in liquid state (36A) changes state. Preferably, a third flow guide structure (219) for facilitating spiral flow of the vaporous second fluid (35B) is arranged in the third heat exchange channel (211) and/or a fourth flow guide structure (220) for facilitating spiral flow of the first fluid in liquid state (36A) is arranged in the fourth heat exchange channel (212). Preferably, wherein the first fluid path is capable of being in fluid communication with the outside by selectively opening a first valve (222); and/or wherein the energy transmission device further comprising a first heating device (318), configured to heat and vaporize a liquid (35A) in the first fluid path; and/or wherein the first valve is in an open state when the first heating device (318) is vaporizing the fluid (35A) therein. Preferably, the energy transmission device further comprises a fluid delivery device (213/314) for facilitating circulation of a vaporous fluid (35B) inside the first channel; and/or for facilitating circulation of a fluid in liquid state (35A) inside the second channel.

Preferably, the energy transmission device further comprises a first chamber (315) located in the second channel and configured to contain a fluid in liquid state (35A) therein, and a second chamber (322) for collecting and containing a fluid in liquid state (36C) formed by condensation of a vaporous fluid (36B) in the second fluid path, wherein the first chamber (315) and the second chamber (322) is capable of being in fluid communication by opening a second valve (603).

A fifth alternative embodiment of the present application provides an energy transmission device (1) comprising: a first fluid path including a first channel and a second channel for a first fluid (35) to flow therein; a compressor (11) positioned between the first channel and the second channel and configured to compress the first fluid in the vapor state (35B); a regulating valve (12) positioned between the first channel and the second channel at a location distinct from the compressor (11); a first heat exchanger (21) formed at least partially by the first channel for facilitating release of heat energy from the first fluid (35B) flowing in a vapor state; a second heat exchanger (31) formed at least partially by the second channel for facilitating absorption of heat energy by the first fluid (35A) flowing in a liquid state; a first flow guide structure (219) arranged within the first heat exchanger (21) for promoting the spiral flow of the first fluid (35B) in the vapor state; and a second flow guide structure (320) arranged within the second heat exchanger (31) for promoting the spiral flow of the first fluid (35A) in the liquid state; wherein the first fluid path is sealed during energy transmission; wherein the compressor (11) and the regulating valve (12) are configured to adjust a pressure in the first channel and a pressure in the second channel such that the first channel and the second; channel have different pressures during the operation of the energy transmission device; and wherein at least one of the first flow guide structure (219) and the second flow guide structure (320) is movable, wherein the first fluid path is capable of being in fluid communication with the outside by selectively opening a first valve (222); and or wherein the energy transmission device further comprising a first heating device (318), configured to heat and vaporize a liquid (35A) in the first fluid path; and/or wherein the first valve is in an open state when the first heating device (318) is vaporizing the fluid (35A) therein. Preferably, the energy transmission device further comprises a fluid delivery device (213/314) for facilitating circulation of a vaporous fluid (35B) inside the first channel; or for facilitating circulation of a fluid in liquid state (35A) inside the second channel.

A sixth alternative embodiment of the present application provides energy transmission device (1) comprising: a first fluid path including a first channel and a second channel for a first fluid (35) to flow therein; a compressor (11) positioned between the first channel and the second channel and configured to compress the first fluid in the vapor state (35B); a regulating valve (12) positioned between the first channel and the second channel at a location distinct from the compressor (11); a first heat exchanger (21) formed at least partially by the first channel for facilitating release of heat energy from the first fluid (35B) flowing in a vapor state; a second heat exchanger (31) formed at least partially by the second channel for facilitating absorption of heat energy by the first fluid (35A) flowing in a liquid state; a first flow guide structure (219) arranged within the first heat exchanger (21) for promoting the spiral flow of the first fluid (35B) in the vapor state; and a second flow guide structure (320) arranged within the second heat exchanger (31) for promoting the spiral flow of the first fluid (35A) in the liquid state; wherein the first fluid path is sealed during energy transmission; wherein the compressor (11) and the regulating valve (12) are configured to adjust a pressure in the first channel and a pressure in the second channel such that the first channel and the second channel have different pressures during the operation of the energy transmission device; and wherein at least one of the first flow guide structure (219) and the second flow guide structure (320) is movable; a second fluid path for a second fluid (36A, 36B) to flow, wherein the first fluid path intersects in non-fluid communication with the second fluid path at the first heat exchanger (21) and the second heat exchanger (31), and the energy transmission device is configured such that when flowing through the first heat exchanger (21), the vaporous first fluid (35B) exchanges heat with a second fluid in liquid state (36A) in the second fluid path, so that at least a part of the second fluid in liquid state (36A) and at least a part of the vaporous first fluid (35B) changes state; and when flowing through the second heat exchanger (31), the first fluid in liquid state (35A) exchanges heat with the vaporous second fluid (36B), so that at least a part of the first fluid in liquid state (35A) and at least a part of the vaporous second fluid (36B) changes state; a first chamber (315) located in the second channel and configured to contain a fluid in liquid state (35A) therein, and a second chamber (322) for collecting and containing a fluid in liquid state (36C) formed by condensation of a vaporous fluid (36B) in the second fluid path, wherein the first chamber (315) and the second chamber (322) is capable of being in fluid communication by opening a second valve (603).

What are described above are merely preferred embodiments of the present application, and are not intended to limit the present application. Any modification, equivalent substitution, improvement, etc. performed within the spirit and principle of the present application should fall within the scope of protection of the present application.

The invention claimed is:

1. An energy transmission device comprising:

a first fluid path including a first channel and a second channel for a first fluid to flow therein;

a compressor positioned between the first channel and the second channel and configured to compress the first fluid in a vapor state;

a regulating valve positioned between the first channel and the second channel at a location distinct from the compressor;

a first heat exchanger formed at least partially by the first channel for facilitating release of heat energy from the first fluid flowing in the vapor state;

a second heat exchanger formed at least partially by the second channel for facilitating absorption of heat energy by the first fluid flowing in a liquid state;

a first flow guide structure arranged within the first heat exchanger for promoting the spiral flow of the first fluid in the vapor state; and a second flow guide structure arranged within the second heat exchanger for promoting the spiral flow of the first fluid in the liquid state, wherein the first fluid path is sealed during energy transmission, wherein the compressor and the regulating valve are configured to adjust a pressure in the first channel and a pressure in the second channel such that the first channel and the second channel have different pressures during the operation of the energy transmission device, and wherein the first flow guide structure is operably movable relative to the second flow guide structure and/or the second flow guide structure is operably movable relative to the first flow guide structure.

2. The energy transmission device of claim 1, further comprising a second fluid path for a second fluid to flow, wherein the first fluid path intersects in non-fluid communication with the second fluid path at the first heat exchanger and the second heat exchanger, and the energy transmission device is configured such that when flowing through the first heat exchanger, the first fluid in the vapor state exchanges heat with a second fluid in a liquid state in the second fluid path, so that at least a part of the second fluid in a liquid state and at least a part of the first fluid in the vapor state changes state; and when flowing through the second heat exchanger, the first fluid in a liquid state exchanges heat with the second fluid in a vapor state, so that at least a part of the first fluid in a liquid state and at least a part of the second fluid in the vapor state changes state.

3. The energy transmission device of claim 2, wherein at least a part of the second flow guide structure is adjacent to an inner wall of the second channel forming the second heat exchanger, and a spiral channel is formed along the inner wall; and at least a part of the first flow guide structure is adjacent to an outer wall of the second fluid path in the first heat exchanger, and a spiral channel is formed along the outer wall.

4. The energy transmission device of claim 2 further comprising:

a first chamber located in the second channel and configured to contain a fluid in the liquid state therein; and a second chamber for collecting and containing a fluid in the liquid state formed by condensation of a fluid in the vapor state in the second fluid path, wherein the first chamber and the second chamber are capable of being in fluid communication by opening a second valve.

5. The energy transmission device of claim 1 wherein the first fluid path is capable of being in fluid communication with the outside by selectively opening a first valve, and/or wherein the energy transmission device further comprising a heater, configured to heat and vaporize a liquid in the first fluid path, and/or wherein the first valve is in an open state when the heater is vaporizing the liquid therein.

6. The energy transmission device of claim 1 further comprising a fluid delivery device for facilitating circulation of a fluid in the vapor state inside the first channel or for facilitating circulation of a fluid in the liquid state inside the second channel.

7. A heat exchange device for exchanging heat between a first fluid in a vapor state and a second fluid in a liquid state comprising:

a first heat exchange channel for a first fluid in the vapor state to flow and release heat;

a second heat exchange channel for a second fluid in the liquid state to flow and absorb heat;

a first flow guide structure for facilitating spiral flow of the first fluid in the vapor state around the second heat exchange channel; and a second flow guide structure for facilitating spiral flow of the second fluid in the liquid state in the second heat exchange channel, wherein the first flow guide structure is operably movable relative to the second flow and/or the second flow guide structure is operably movable relative to the first flow guide structure, and wherein the heat exchange device is configured so that, during heat exchange, at least a part of the first fluid in the vapor state and at least a part of the second fluid in the liquid state changes state.

8. The heat exchange device of claim 7, wherein at least a part of the first flow guide structure is adjacent to an outer wall of the second heat exchange channel and a spiral channel is formed along the outer wall, and/or at least a part of the second flow guide structure is adjacent to an inner wall of the second heat exchange channel, and a spiral channel is formed along the inner wall.

9. An energy transmission device comprising the heat exchange device of claim 7, further comprising:

a first fluid path for a first fluid in the vapor state and a first fluid in the liquid state to flow, wherein the first fluid path includes a first channel and a second channel;

a compressor positioned between the first channel and the second channel and configured to compress the first fluid in the vapor state; and a regulating valve positioned between the first channel and the second channel at a location distinct from the compressor;

wherein the first heat exchange channel is formed by at least a part of the first channel, wherein at least a part of the second channel forms a third heat exchange channel for the first fluid in the liquid state to flow and absorb heat, wherein the first fluid path is sealed during energy transmission, wherein the compressor and the regulating valve are configured to adjust a pressure in the first channel and a pressure in the second channel such that the first channel and the second channel are in different pressures during the operation of the energy transmission device, and wherein the energy transmission device is configured to transmit heat energy from the third heat exchange channel to the second heat exchange channel.

10. The energy transmission device of claim 9, further comprising a second fluid path for a second fluid in a vapor state and a second fluid in a liquid state to flow, wherein the second fluid path intersects in-non-fluid communication with the first fluid path, wherein the second heat exchange channel is formed by at least a part of the second fluid path, wherein the second fluid path further forms a fourth heat exchange channel for the second fluid in a vapor state to flow and release heat to a first fluid in the liquid state in the third heat exchange channel, and wherein when flowing through the third and the fourth heat exchange channel, at least a part of the first fluid in liquid state and at least a part of the second fluid in the vapor state changes state.

11. The energy transmission device of claim 10, wherein a third flow guide structure for facilitating spiral flow of the first fluid in liquid state is arranged in the third heat exchanger channel, and/or a fourth flow guide structure for facilitating spiral flow of the second fluid in the vapor state is arranged in the fourth heat exchange channel.

12. The energy transmission device of claim 10 further comprising:

a first chamber located in the second channel and configured to contain a fluid the in liquid state therein; and a second chamber for collecting and containing a fluid in the liquid state formed by condensation of a fluid in the vapor state in the second fluid path, wherein the first chamber and the second chamber are capable of being in fluid communication by opening a second valve.

13. The energy transmission device of claim 9 wherein the first fluid path is capable of being in fluid communication with the outside by selectively opening a first valve, and/or wherein the energy transmission device further comprises a heater, configured to heat and vaporize a liquid in the first fluid path, and/or wherein the first valve is in an open state when the heater is vaporizing the liquid therein.

14. The energy transmission device of claim 9 further comprising a fluid delivery device for facilitating circulation of a fluid in the vapor state inside the first channel or for facilitating circulation of a fluid in the liquid state inside the second channel.

15. An energy transmission device comprising the heat exchange device of claim 7, further comprising:

a first fluid path for the second fluid in the liquid state and the second fluid in the vapor state to flow, wherein the first fluid path includes a first channel and a second channel;

a compressor positioned between the first channel and the second channel and configured to compress the second fluid in the vapor state; and a regulating valve positioned between the first channel and the second channel at a location distinct from the compressor, wherein the second heat exchange channel is formed by at least a part of the second channel, wherein at least a part of the first channel forms a third heat exchange channel for the second fluid in the vapor state to flow and release heat, wherein the first fluid path is sealed during energy transmission, wherein the compressor and the regulating valve are configured to adjust a pressure in the first channel and a pressure in the second channel such that the first channel and the second channel are in different pressures during the operation of the energy transmission device, and wherein the energy transmission device is configured to transmit heat energy from the first heat exchange channel to the third heat exchange channel.

16. The energy transmission device of claim 15, further comprising a second fluid path for the first fluid in a vapor state and the first fluid in the liquid state to flow, wherein the second fluid path intersects in non-fluid communication with the first fluid path, and wherein the first heat exchange channel is formed by at least a part of the second fluid path, wherein the second fluid path further forms a fourth heat exchange channel for the first fluid in the liquid state to flow and absorb heat from the second fluid in the third heat exchange channel, and wherein when flowing through the third and fourth heat exchange channel, at least a part of the second fluid in the vapor state and at least a part of the first fluid in the liquid state changes state.

17. The energy transmission device of claim 16, further comprising a third flow guide structure for facilitating spiral flow of the second fluid in the vapor state in the third heat exchange channel; and/or a fourth flow guide structure for facilitating spiral flow of the first fluid in the liquid state in the fourth heat exchange channel.

18. The energy transmission device of claim 16 further comprising:

a first chamber located in the second channel and configured to contain a fluid in the liquid state therein; and a second chamber for collecting and containing a fluid in the liquid state formed by condensation of a fluid in the vapor state in the second fluid path, wherein the first chamber and the second chamber are capable of being in fluid communication by opening a second valve.

19. The energy transmission device of claim 15 wherein the first fluid path is capable of being in fluid communication with the outside by selectively opening a first valve, and/or wherein the energy transmission device further comprises a heater, configured to heat and vaporize a liquid in the first fluid path, and/or wherein the first valve is in an open state when the heater is vaporizing the liquid therein.

20. The energy transmission device of claim 15 further comprising a fluid delivery device for facilitating circulation of a fluid in the vapor state inside the first channel or for facilitating circulation of a fluid in the liquid state inside the second channel.

* * * * *